US011453213B2

(12) United States Patent
Kurashima et al.

(10) Patent No.: US 11,453,213 B2
(45) Date of Patent: Sep. 27, 2022

(54) DRIVING METHOD OF LIQUID FEEDING APPARATUS

(71) Applicant: CANON KABUSHIKI KAISHA, Tokyo (JP)

(72) Inventors: Rei Kurashima, Yokohama (JP); Akihisa Iio, Yokohama (JP); Takahiro Akiyama, Atsugi (JP); Toru Nakakubo, Kawasaki (JP); Noriyuki Kaifu, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/727,524

(22) Filed: Dec. 26, 2019

(65) Prior Publication Data

US 2020/0207078 A1 Jul. 2, 2020

(30) Foreign Application Priority Data

Dec. 28, 2018 (JP) ..... JP2018-247865
Sep. 27, 2019 (JP) ..... JP2019-177314

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
None
See application file for complete search history.

(56) References Cited

U.S. PATENT DOCUMENTS 7,094,040 B2 8/2006 Higashino et al.
10,300,707 B2 5/2019 Nakakubo et al.
2009/0219313 A1* 9/2009 Suzuki ..... B41J 2/04588 347/9
2015/0099059 A1* 4/2015 Harjee ..... B41J 2/04535 427/8
2019/0001692 A1 1/2019 Yamazaki et al.
2019/0023016 A1 1/2019 Nakagawa et al.
2019/0023018 A1 1/2019 Nakagawa et al.

FOREIGN PATENT DOCUMENTS

JP 2004-183494 A 7/2004
WO 2013/032471 A1 3/2013

OTHER PUBLICATIONS

U.S. Appl. No. 16/720,940, filed Dec. 19, 2019, Takuro Yamazaki Yoshiyuki Nakagawa Toru Nakakubo Kazuhiro Yamada Ryo Kasai.
U.S. Appl. No. 16/727,511, filed Dec. 26, 2019, Toru Nakakubo Akihisa Iio Rei Kurashima Takahiro Akiyama Hiroyuki Ozaki.
U.S. Appl. No. 16/727,541, filed Dec. 26, 2019, Rei Kurashima Akihisa Iio Takahiro Akiyama Toru Nakakubo Noriyuki Kaifu.

* cited by examiner

*Primary Examiner* — Erica S Lin
(74) *Attorney, Agent, or Firm* — Venable LLP

(57) ABSTRACT

A driving method enables a liquid feeding apparatus using a driving element in the form of a membrane to feed a liquid at high liquid feeding accuracy. To this end, a voltage applied to the driving element is controlled in such a way as to repeat a first period in which the voltage is changed from a first voltage to a second voltage and a second period which is a longer period than the first period and in which the voltage is changed from the second voltage to the first voltage, and such that an inflection point is provided in each predetermined interval during the first period based on a Helmholtz vibration period unique to the liquid feeding apparatus.

14 Claims, 21 Drawing Sheets

DRIVING METHOD OF LIQUID FEEDING APPARATUS

BACKGROUND OF THE DISCLOSURE

Field of the Disclosure

This disclosure relates to a driving method of a liquid feeding apparatus.

Description of the Related Art

With the advance of microelectromechanical systems (MEMS) techniques (micromachining techniques) in recent years, there have been proposed liquid feeding apparatuses designed to feed a liquid in the order of micrometers.

Japanese Patent Laid-Open No. 2004-183494 discloses a micropump that utilizes an action of a fluid as a valve mechanism instead of using a mechanical valve structure while taking advantage of a characteristic of flow channel resistance that the flow channel resistance changes non-linearly with respect to a flow velocity. According to the micropump disclosed in Japanese Patent Laid-Open No. 2004-183494, it is possible to feed a liquid in the order of micrometers with a simple and small configuration that uses a small number of components. Japanese Patent Laid-Open No. 2004-183494 discloses a driving method in which a piezoelectric element in a membrane shape is used as a driving source, and the piezoelectric element is caused to function as a pump by changing a voltage applied to the piezoelectric element asymmetrically with respect to time.

Meanwhile, International Publication No. WO2013/032471 discloses an inkjet head using a piezoelectric element in a membrane shape. International Publication No. WO2013/032471 describes a driving method of a piezoelectric element aiming at ejecting liquid droplets and a driving method of a piezoelectric element aiming at circulating an ink in a liquid chamber.

SUMMARY OF THE DISCLOSURE

In a first aspect of the present invention, there is provided a driving method of a liquid feeding apparatus including a liquid chamber configured to store a liquid, and a driving element provided in the liquid chamber and configured to circulate a liquid stored in the liquid chamber to an external unit by expanding and contracting a capacity of the liquid chamber along with application of a voltage, the method comprising: controlling the voltage applied to the driving element in such a way as to repeat a first period in which the voltage is changed from a first voltage to a second voltage and a second period which is a longer period than the first period and in which the voltage is changed from the second voltage to the first voltage; and controlling the voltage applied to the driving element such that an inflection point is provided to each predetermined interval during the first period based on a Helmholtz vibration period unique to the liquid feeding apparatus.

In a second aspect of the present invention, there is provided a liquid ejection head comprising: a pressure chamber communicating with an ejection port and configured to store a liquid to be ejected from the ejection port; an energy generation element provided in the pressure chamber and configured to generate energy to be used to eject the liquid from the ejection port; a supply flow channel configured to supply the liquid to the pressure chamber; a collection flow channel configured to collect the liquid from the pressure chamber; a liquid feeding chamber connected to the collection flow channel; a connection flow channel connecting the liquid feeding chamber to the supply flow channel; a driving element configured to circulate the liquid in the supply flow channel, the pressure chamber, the collection flow channel, the liquid feeding chamber, and the connection flow channel by expanding and contracting a capacity of the liquid feeding chamber; and a control unit configured to control a voltage applied to the driving element, wherein the control unit controls the voltage applied to the driving element in such a way as to repeat a first period in which the voltage is changed from a first voltage to a second voltage and a second period which is a longer period than the first period and in which the voltage is changed from the second voltage to the first voltage, and the control unit controls the voltage applied to the driving element such that an inflection point is provided to each predetermined interval during the first period based on a Helmholtz vibration period unique to circulation flow channels including the supply flow channel, the pressure chamber, the collection flow channel, the liquid feeding chamber, and the connection flow channel.

Further features of the present disclosure will become apparent from the following description of exemplary embodiments with reference to the attached drawings.

DESCRIPTION OF THE EMBODIMENTS

The liquid feeding apparatuses disclosed in Japanese Patent Laid-Open No. 2004-183494 and International Publication No. WO2013/032471 constantly move a liquid by repeating an operation to suddenly expand a capacity of a liquid feeding chamber and an operation to gradually contract the capacity while displacing the piezoelectric element (the actuator) in the membrane shape. However, according to the above-mentioned configurations, there may be a case where occurrence of residual vibration at a Helmholtz frequency unique to each liquid feeding apparatus causes individual vibration to overlap a change in capacity at the time of gradual contraction, thus resulting in a loss in liquid feeding amount. Here, if the capacity of the liquid feeding chamber is smaller and the liquid feeding amount becomes less, the aforementioned loss in liquid feeding amount has a larger impact on liquid feeding efficiency which is not negligible.

This disclosure has been made to solve the aforementioned problem, and an object thereof is to provide a driving method of a liquid feeding apparatus adopting a piezoelectric element having a membrane shape, which enables the apparatus to feed a liquid at high liquid feeding efficiency.

First Embodiment

Figure 1A:
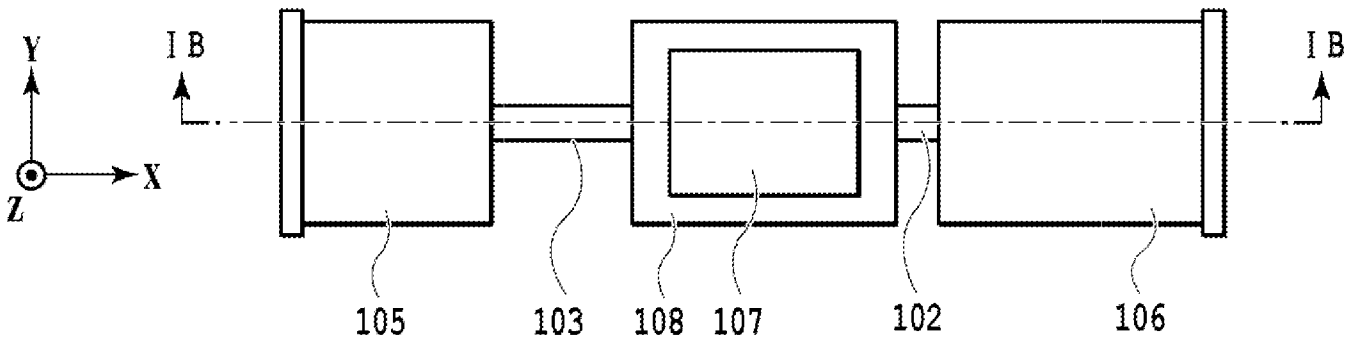
FIGS. 1A and 1B are schematic diagrams of a liquid feeding apparatus usable in this disclosure.
Figure 1B:
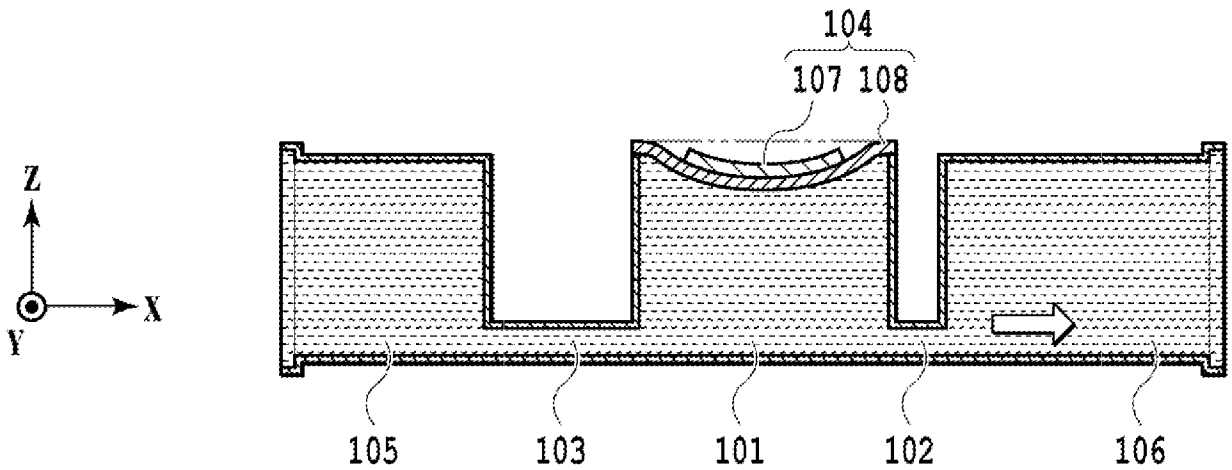

FIGS. 1A and 1B are schematic diagrams of a liquid feeding apparatus usable in this embodiment. FIG. 1A is a top plan view and FIG. 1B is a cross-sectional view. A liquid feeding chamber 101, a first flow channel 105, and a second flow channel 106 are connected in series in X direction of FIGS. 1A and 1B. The liquid feeding chamber 101 is connected to the first flow channel 105 through a first connection flow channel 103, and is connected to the second flow channel 106 through a second connection flow channel 102. The first flow channel 105 and the second flow channel 106 are connected to an external unit so that a liquid can be supplied from or discharged to the external unit. Flow channel resistance of the first connection flow channel 103 is higher than flow channel resistance of the second connection flow channel 102. Flow channel resistance of each of the liquid feeding chamber 101, the first flow channel 105, and the second flow channel 106 has a sufficiently low value than that of the first connection flow channel 103 and the second connection flow channel 102.

An actuator 104 of a membrane structure is provided as a driving element on a wall surface of the liquid feeding chamber 101. The actuator 104 includes a thin-film piezoelectric body 107 and a vibration plate 108. A wire (not shown) for supplying electric power and a wire (not shown) for providing a common potential (GND) are connected to the thin-film piezoelectric body 107. In the case where a voltage is applied to the thin-film piezoelectric body 107 through these wires, the vibration plate 108 is displaced in ±Z directions. Although AC is applied to the thin-film piezoelectric body 107 in a state of applying DC-BIAS in advance, only the AC waveforms will be illustrated below while disregarding the DC-BIAS for the purpose of simplifying the explanations. FIG. 1B shows a default state in which the AC voltage is not applied to the thin-film piezoelectric body 107. Here, the vibration plate 108 is displaceable to a position indicated with a dashed line in FIG. 1B in accordance with the level of the voltage to be applied to the thin-film piezoelectric body 107.

Specific dimensions of the above-mentioned structure will be described below. In the liquid feeding apparatus of this embodiment, the dimensions of the liquid feeding chamber 101 are set to about 250 μm in X direction×about 120 μm in Y direction×about 250 μm in Z direction. The dimensions of the first connection flow channel 103 are set to about 200 μm in the X direction×about 25 μm in the Y direction×about 25 μm in the Z direction. The dimensions of the second connection flow channel 102 are set to about 25 μm in the X direction×about 15 μm in the Y direction×about 25 μm in the Z direction.

The above-described liquid feeding apparatus can be formed by using general-purpose MEMS techniques. For example, the liquid feeding apparatus can be formed by subjecting a Si substrate to any of vacuum plasma etching and anisotropic etching with an alkaline solution, or a combination thereof. Alternatively, the liquid feeding apparatus may be formed by providing flow channels inclusive of the liquid feeding chamber 101 and the actuator 104 separately on different Si substrates and then attaching the flow channels to the actuator 104 by means of bonding or adhesion.

A unimorph piezoelectric actuator is used as the actuator 104. The unimorph piezoelectric actuator has a configuration in which the thin-film piezoelectric body 107 is formed on one surface side of the vibration plate 108. This actuator 104 can be formed by attaching the vibration plate 108 so as to block an opening of the liquid feeding chamber 101 and further attaching the thin-film piezoelectric body 107 to a surface thereof.

The material of the vibration plate 108 is not limited to a particular material as long as required conditions such as mechanical performances and reliability are satisfied. For example, materials such as a silicon nitride film, silicon, metals, and heat-resistant glass can be favorably used.

The thin-film piezoelectric body 107 can be deposited by using such a method as vacuum sputtering deposition, sol-gel deposition, and CVD deposition. In many cases, the deposited film is subjected to firing. While the firing method is not limited, it is possible to use a lamp-anneal heating method designed to perform firing around 650° C. at the maximum under an oxygen atmosphere, for instance. Meanwhile, in light of consistency with a process flow, the thin-film piezoelectric body 107 may be directly deposited on the vibration plate 108 and then integrally fired, or may be deposited on a different substrate from the vibration plate 108 and then released and transferred onto the vibration plate 108 after firing. Alternatively, the thin-film piezoelectric body 107 may be deposited on a different substrate from the vibration plate 108 and then subjected to integral firing after the thin-film piezoelectric body 107 is released and transferred onto the vibration plate 108.

As for the electrodes, it is preferable to select a Pt-based material in the case where the electrodes are supposed to undergo the firing process. However, an Al-based material can be selected if it is possible to segregate the firing process. In this embodiment, a PZT-based piezoelectric material is used for the thin-film piezoelectric body 107 as a material that renders the thin-film piezoelectric body 107 displaceable in a highly linear state, that is, in a highly responsive manner to the applied voltage.

In this embodiment, an SOI substrate in a thickness of about 1 to 2 μm is used as the vibration plate 108. A Ti/Pt/PZT layer in a thickness of about 1 to 3 μm is formed on a surface in the −Z direction of the thin-film piezoelectric body 107 as an electrode opposed to the vibration plate 108. Meanwhile, a Ti-based alloy layer is formed on a surface in the +Z direction of the thin-film piezoelectric body 107. This surface is coated with a SiN-based protection film serving as an outermost layer exposed to the atmosphere, thus sealing the entire actuator 104.

Then, the liquid feeding apparatus and a relay board for transferring the signal wire to the liquid feeding apparatus are attached to a not-illustrated holding frame, and the liquid feeding apparatus and the relay board are electrically coupled by wire bonding. Furthermore, manifolds serving as an inlet port and an outlet port for the liquid are connected to the first flow channel 105 and the second flow channel 106 and fixed thereto with an adhesive. Thus, formation of the liquid feeding apparatus is finished.

Next, a description will be given of a measurement method used in the case where the inventors of this disclosure actually conducted the liquid feeding by using the liquid feeding apparatus. The inventors adopted particle tracking velocimetry (PTV) generally known as a method of flow evaluation. The liquid for feeding was prepared by mixing purified water tailored to a clean room with glycerin for adjusting viscosity and with 1.2-hexanediol for adjusting surface tension such that the mixture had the viscosity of about 3 cps and the surface tension of about 30 mN/m. Tracer particles having diameters in a range from about 1 to 3 μm were mixed into the liquid thus prepared and the mixture was agitated for a while. After removing unnecessary bubbles by using a decompression apparatus, the liquid was put into the liquid feeding apparatus through a tube. In this instance, all liquid chambers inclusive of the liquid feeding chamber 101 and all flow channels were filled with the liquid not only by making use of a difference in hydraulic head pressure between a supply side and a discharge side but also by conducting an operation to forcibly suction the liquid from the discharge side.

The actuator 104 was continuously driven while repeatedly applying a unit waveform voltage at a period of 50 μsec. The unit waveform was generated by using an arbitrary waveform generation apparatus. The waveform thus generated was amplified with a bipolar high-speed AMP, and was supplied to the thin-film piezoelectric body 107 through the wires while causing the waveform to overlap the BIAS voltage.

The flow thus generated was measured by observing the tracer particles in the liquid under a microscope mounting a high-speed camera. A trigger of a driving signal for the actuator 104 was taken in as a start signal for the high-speed camera, and images of the tracer particles were shot before and after the driving. To be more precise, the image shooting was started 1 msec before the trigger signal. Coordinates of the tracer particles in the respective images corresponding to time points were analyzed and flow velocities and other data were obtained by using amounts of movement of the tracer particles per unit time.

Displacement rates of the vibration plate 108 were measured with a laser Doppler displacement meter and a change in capacity of the liquid feeding chamber 101 was calculated by integrating the obtained rates.

Figure 2A:
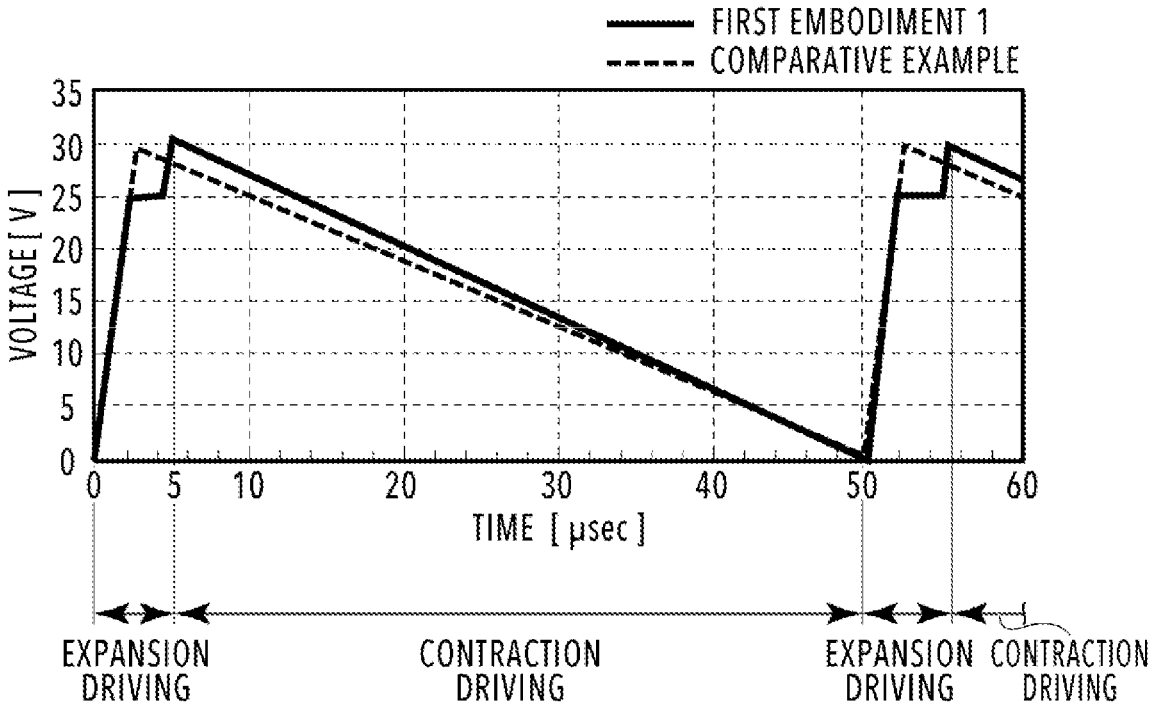
FIGS. 2A and 2B are graphs showing applied voltages and amounts of change in capacity of a liquid feeding chamber according to a first embodiment.
Figure 2B:
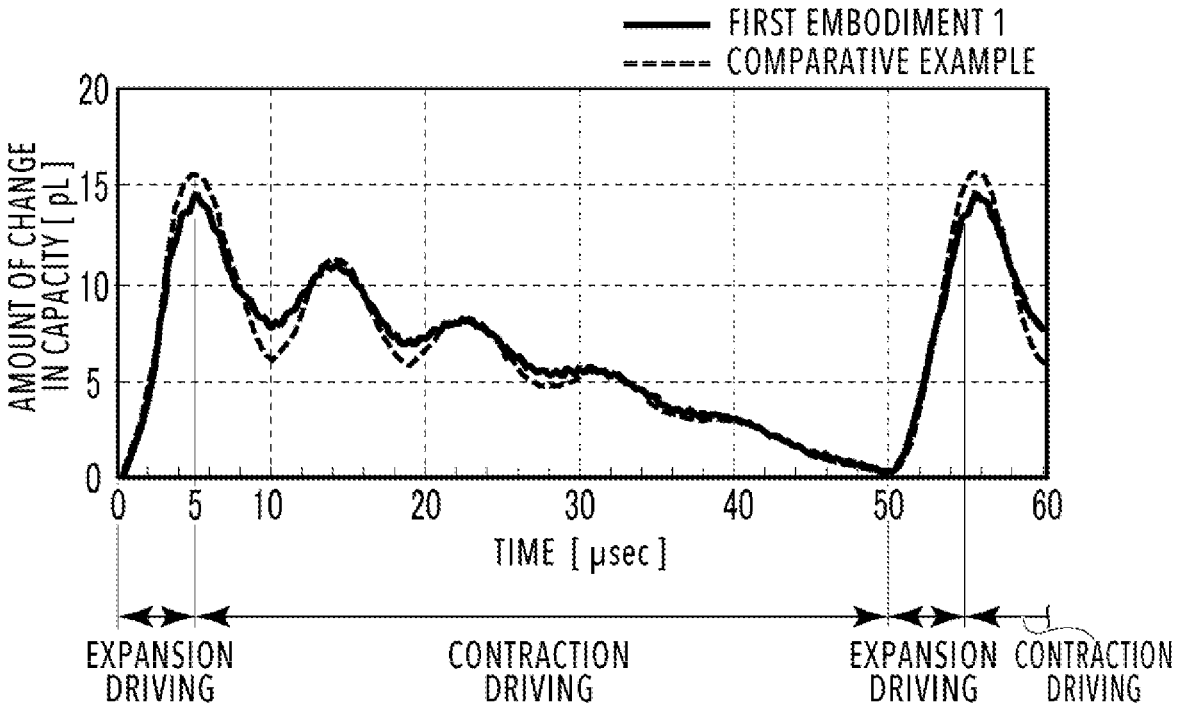

FIGS. 2A and 2B are graphs showing voltages to be applied to the actuator 104 and amounts of change in capacity of the liquid feeding chamber 101 to be increased and decreased depending on the voltages in this embodiment. In each of FIGS. 2A and 2B, a solid line indicates this embodiment while a dashed line indicates a comparative example. In FIG. 2A, DC-BIAS at −30 V or below is applied, for example. However, illustration of this voltage is omitted therein.

FIG. 2A is a graph which illustrates a voltage waveform of this embodiment to be applied to the actuator 104 in comparison with a waveform in the comparative example. Here, a direction of expansion of the capacity of the liquid feeding chamber 101 is defined as a positive direction of the voltage. Meanwhile, a maximum voltage is set to 30 V, a driving period is set to 50.0 μm, and a driving frequency is set to 20 kHz.

The voltage in the comparative example takes on a triangular voltage waveform that has heretofore been used in general. The voltage is increased from 0 V to 30 V at a constant gradient during a period from time t=0.0 μsec to time t=2.5 μsec. Then, the voltage is decreased from 30 V to 0 V at a constant gradient during a period from time t=2.5 μsec to time t=50.0 μsec. Thereafter, the aforementioned increase and decrease in voltage are repeated at a cycle of 50.0 μsec.

Meanwhile, in the first embodiment, the voltage is increased from 0 V to 25 V at the same gradient as that of the comparative example during a period from time t=0.0 μsec to time t≈2.1 μsec, and is maintained at 25 V during a period from time t≈2.1 μsec to time t≈5.0 μsec. Then, the voltage is increased from 25 V to 30 V at a constant gradient during a period from time t≈5.0 μsec to time t≈5.4 μsec, and is further decreased from 30 V to 0 V at a constant gradient during a period from time t≈5.4 μsec to time t=50.0 μsec. Thereafter, the aforementioned increase and decrease in voltage are repeated at a cycle of 50.0 μsec.

In each of the comparative example and the first embodiment, the voltage is increased in a relatively short period and is decreased in a relatively long period. As a consequence, the capacity of the liquid feeding chamber 101 repeats sudden expansion and gradual contraction. Hence, repetition of the sudden expansion and the gradual contraction generates a constant flow heading in a definite direction.

Now, a mechanism for generating the constant flow in the liquid feeding chamber 101 will be briefly explained. In the case where the liquid feeding chamber 101 is suddenly expanded, a vortex is generated under a high flow velocity on the second connection flow channel 102 side where the flow channel resistance is low, and this vortex blocks the liquid that is likely to flow from the second flow channel 106 into the liquid feeding chamber 101. On the other hand, in the case where the liquid feeding chamber 101 is gradually contracted, no vortex is generated under a low flow velocity and the liquid slowly flows out of the liquid feeding chamber 101 to the second flow channel 106. In the meantime, on the first connection flow channel 103 side where the flow channel resistance is high, the liquid can flow into or out of the liquid feeding chamber 101 irrespective of the rate of expansion or contraction of the liquid feeding chamber 101. In other words, the constant flow in the X direction in FIGS. 1A and 1B is generated by repeating the expansion that blocks the inflow from the second connection flow channel 102 and the contraction that does not block the outflow to the second connection flow channel 102.

FIG. 2B is a graph showing the amounts of change in capacity of the liquid feeding chamber 101 relative to the default state in the case of applying the voltages illustrated in FIG. 2A. In each of the first embodiment and the comparative example, the capacity is significantly increased during a period from time t=0.0 μsec to start the driving to time t=5.0 μsec. Thereafter, the capacity gradually reduces its amplitude while repeating the increase and decrease associated with residual vibration following the drop in voltage, and eventually returns to the initial value (the amount of change in capacity of 0). In FIGS. 2A and 2B, a period of expanding the capacity of the liquid feeding chamber 101 on average is indicated as "expansion driving" while a period of contracting the capacity thereof on average is indicated as "contraction driving".

In the comparative example and in the first embodiment as well, a period of the residual vibration of the amount of change in capacity is about 8.0 μsec, which represents that a primary period Th of the Helmholtz vibration being unique to the liquid feeding apparatus used in this embodiment is about 8.0 μsec and its Helmholtz frequency is therefore about 125 kHz. Now, if the above-mentioned residual vibration overlaps the change in capacity at the time of gradual contraction, the liquid feeding amount is impaired as a consequence.

Nonetheless, a comparison between the comparative example and the first embodiment reveals that the amplitude in the first embodiment is kept lower than that in the comparative example presumably due to the following reason. Specifically, if a period for retaining the voltage at a constant value (or for reducing the gradient of the rise in voltage) is set up within the "expansion driving" period as in the first embodiment, such a change in gradient of the voltage possibly acts on the amplitude of the residual vibration in a diminishing manner. According to the observation by the inventors, the liquid feeding amount per period was about 0.7 pL and the liquid feeding efficiency was about 4.5% in the comparative example, whereas the liquid feeding amount per period was about 1.1 pL and the liquid feeding efficiency was about 7.2% in the first embodiment. In other words, the first embodiment achieves the liquid feeding efficiency about 1.6 times as high as that of the comparative example.

Figure 3:
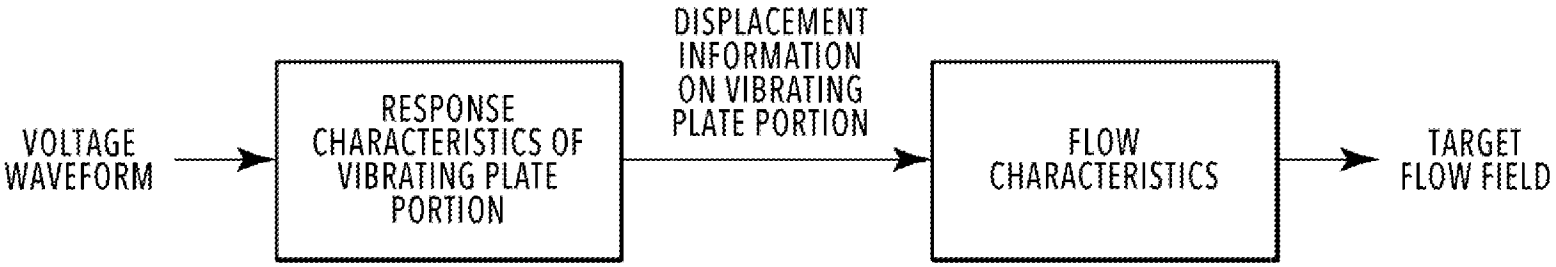
FIG. 3 is a diagram showing a simulation system representing a correlation between a voltage waveform and a flow field.

A process of seeking out the voltage waveform in FIG. 2A by the inventors will be described below. The inventors have conducted a task of associating the voltage waveform to be applied to the actuator 104 with a flow field to be formed in the liquid feeding chamber 101 to begin with. FIG. 3 shows a simulation system representing a correlation between the aforementioned voltage waveform and the flow field produced by the inventors by using a commercially available simulator.

A relation between the voltage and the displacement of the vibration plate 108 in the case of applying the voltage to the actuator 104 that receives a load from the fluid was associated by using a commercially available structure simulator (response characteristics of a vibration plate portion). Meanwhile, a relation between the displacement of the vibration plate 108 and the flow field generated by the displacement was associated by using a commercially available fluid simulator (flow characteristics). Moreover, "how the vibration plate 108 should be displaced in order to realize an ideal flow field" was sought while adjusting displacement information to be inputted to the commercially available fluid simulator. Furthermore, a "voltage waveform for realizing the obtained displacement" was sought by performing back calculation with the commercially available structure simulator.

To be more precise, in a submillimeter-sized structure, a slight phase difference attributed to a compression property of the fluid is developed between the displacement of the vibration plate 108 and the change in capacity of the liquid feeding chamber 101. However, this phase difference does not have a large impact in light of the gist of this disclosure. Accordingly, this disclosure is based on the assumption that a linear relation is maintained between the displacement of the vibration plate 108 and the change in capacity of the liquid feeding chamber.

Figure 4A:
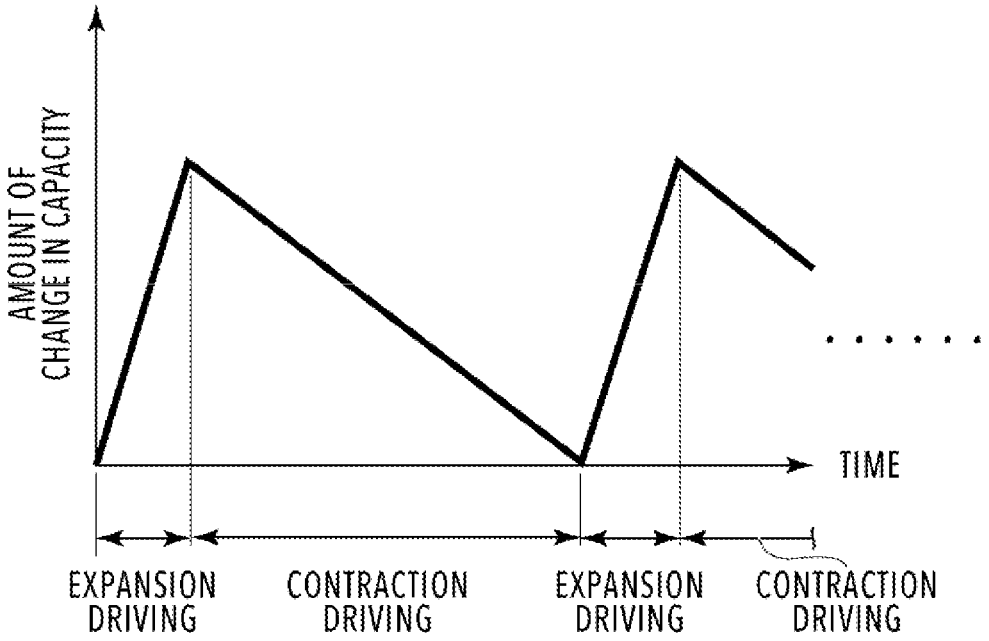
FIGS. 4A and 4B are graphs showing amounts of change in capacity of the liquid feeding chamber for realizing an ideal flow field.
Figure 4B:
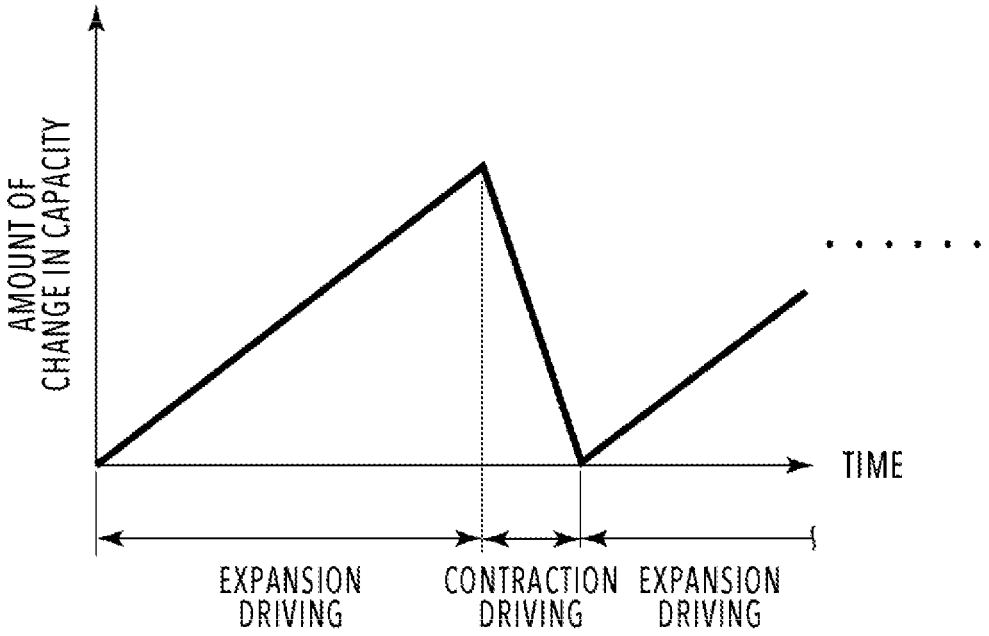

FIGS. 4A and 4B are graphs showing amounts of change in capacity of the liquid feeding chamber 101 for realizing the ideal flow field. FIG. 4A shows the case of repeating the sudden expansion and the gradual contraction of the capacity of the liquid feeding chamber 101, in which the constant flow in the +X direction in FIGS. 1A and 1B is generated. Meanwhile, FIG. 4B shows the case of repeating gradual expansion and sudden contraction of the capacity of the liquid feeding chamber 101, in which a constant flow in the −X direction in FIGS. 1A and 1B is generated. Though it is possible to feed a certain amount of the liquid in each of these cases, the following description will be given of control in order to realize the change in capacity as shown in FIG. 4A.

FIGS. 5A to 5D are graphs showing examples of waveforms of the voltage to be applied to the actuator 104 in order to realize the change in capacity shown in FIG. 4A while conducting a comparison with a comparative example. In each of FIGS. 5A to 5D, the voltage applied to the actuator 104 is indicated with a solid line while the amount of change in capacity of the liquid feeding chamber 101 is indicated with a dashed line. In each of FIGS. 5A to 5D, the DC-BIAS at −30 V or below is applied, for example. However, illustration of this voltage is omitted therein.

Figure 5C:
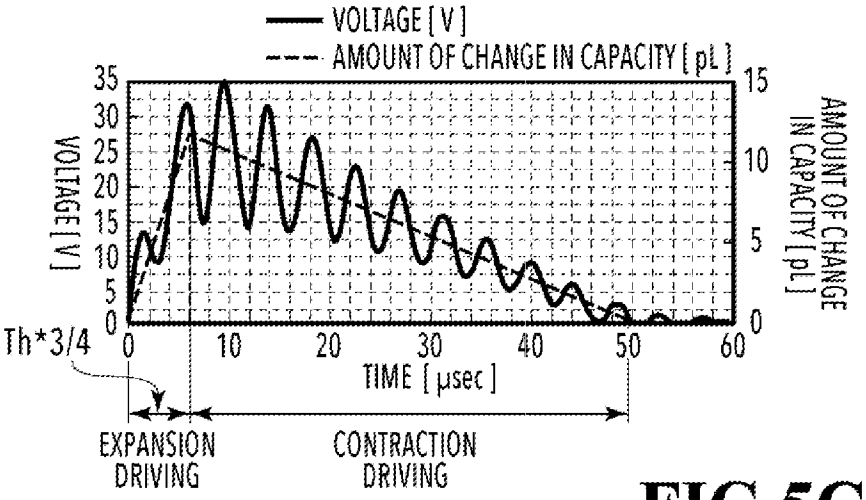
FIGS. 5A to 5D are graphs showing examples of waveforms of a voltage to be applied to an actuator.
Figure 5A:
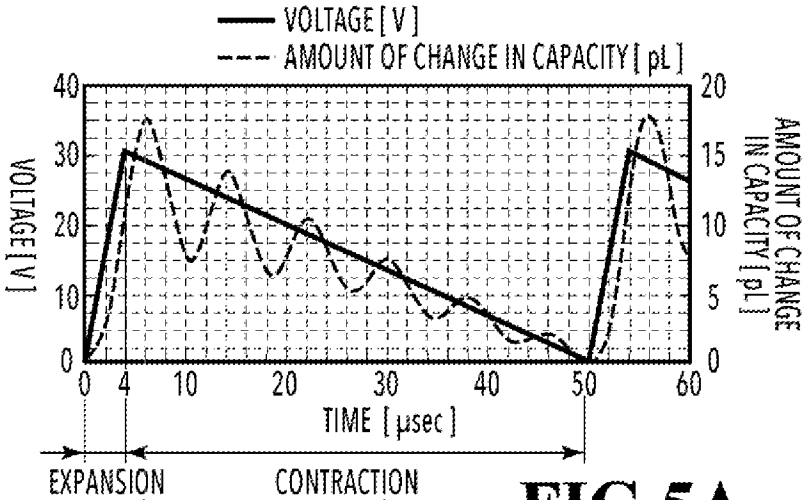

FIG. 5A shows a waveform (the solid line) of the voltage representing the comparative example and a change in capacity (the dashed line) of the liquid feeding chamber 101 associated therewith. A triangular voltage waveform that has heretofore been employed in general is used in the comparative example. Specifically, the voltage is increased from 0 V to 30 V at a constant gradient during a period from time t=0.0 μsec to time t=4.0 μsec. Then, the voltage is decreased from 30 V to 0 V at a constant gradient during a period from time t=4.0 μsec to time t=50.0 μsec.

As described previously, the Helmholtz frequency Fh is set to Fh=125 kHz and the Helmholtz period Th is set to Th=8.0 μsec in the system shown in FIGS. 1A and 1B. Accordingly, in the example shown in FIG. 5A, a period from the start of driving to Th×½ (=4.0 μsec) is allocated to a period for increasing the voltage while the remaining period (from about 4.0 μsec to 50.0 μsec) is allocated to a period for decreasing the voltage. In this way, it is possible to efficiently expand the capacity of the liquid feeding chamber 101. Nonetheless, in the comparative example shown in FIG. 5A, the residual vibration of the Helmholtz period (about 8 μsec) overlaps the change in capacity at the time of gradual contraction, thereby leading to a loss in the liquid feeding amount as a consequence.

Figure 5D:
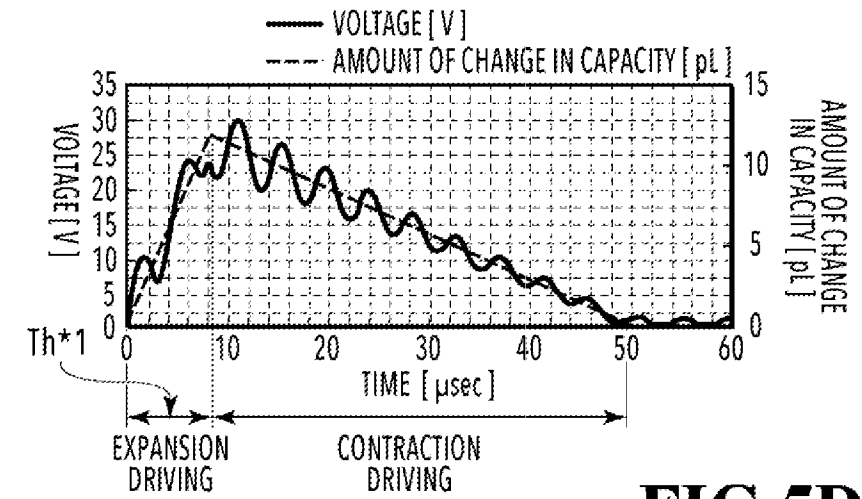
Figure 5B:
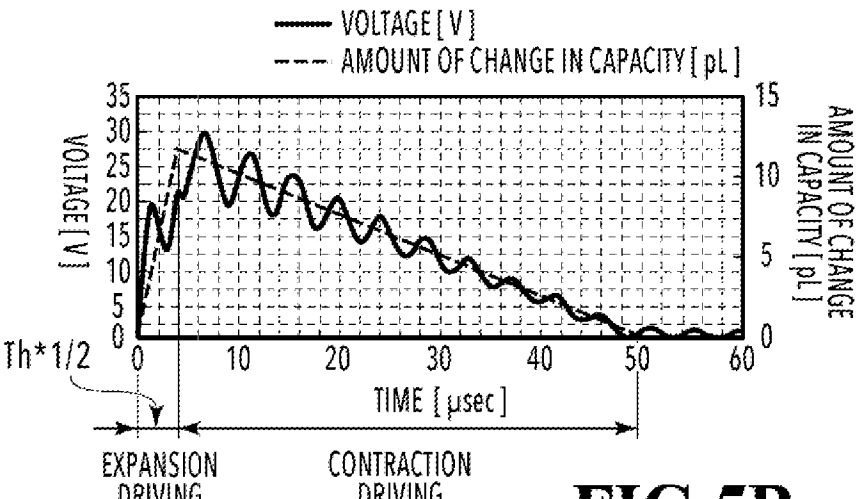

FIG. 5B shows an example of the voltage waveform to be applied to the actuator 104, which is obtained for realizing the change in capacity shown in FIG. 4A, and the change in capacity in the case of applying the voltage waveform. In this example, a period for Th×½ (from 0.0 μsec to 4.0 μsec) corresponds to the expansion driving while the remaining period (from 4.0 μsec to 50.0 μsec) corresponds to the contraction driving. In this example, the voltage is not monotonously increased or decreased in the expansion driving or the contraction driving. Instead, the voltage is increased and decreased in each of the periods in such a way as to alternate a period projecting upward and a period projecting downward. Then, the high-precision voltage increases and decreases as described above almost completely cancel out the residual vibration having the Helmholtz period in the course of the change in capacity of the liquid feeding chamber 101.

FIG. 5C shows another example of the voltage waveform to be applied to the actuator 104, which is obtained for realizing the change in capacity shown in FIG. 4A, and the change in capacity in the case of applying the voltage waveform. In this example, a period for Th×¾ (from 0.0 μsec to 6.0 μsec) is allocated to the expansion driving while the remaining period (from 6.0 μsec to 50.0 μsec) is allocated to the contraction driving. In this example as well, the voltage is increased and decreased in each of the periods in such a way as to alternate a period projecting upward and a period projecting downward. Thus, the residual vibration having the Helmholtz period is almost completely cancelled out.

FIG. 5D shows still another example of the voltage waveform to be applied to the actuator 104, which is obtained for realizing the change in capacity shown in FIG. 4A, and the change in capacity in the case of applying the voltage waveform. In this example, a period for Th×1 (from 0.0 μsec to 8.0 μsec) is allocated to the expansion driving while the remaining period (from 8.0 μsec to 50.0 μsec) is allocated to the contraction driving. In this example as well, the voltage is increased and decreased in each of the periods in such a way as to alternate a period projecting upward and a period projecting downward. Thus, the residual vibration having the Helmholtz period is almost completely cancelled out.

In short, if any of the waveform voltages indicated with the solid lines in FIGS. 5B to 5D can be applied to the actuator 104, the change in capacity of the liquid feeding chamber 101 turns out as indicated with the corresponding dashed line so that high liquid feeding efficiency can be achieved. In actual driving control, however, it is difficult to perform complex waveform control at high precision as indicated with the solid lines in FIGS. 5B to 5D, because the more complex the waveform is the more types of the voltage values need to be prepared, thus leading to complexity of a circuit and increases in costs.

With that in mind, the inventors have sought any factors possibly effective for suppressing the residual vibration out of characteristics common to the waveforms shown in FIGS. 5B to 5D in order to suppress the residual vibration by using a simpler waveform, and have focused on inflection points of the voltage waveforms. Moreover, the inventors have found out that there were inflection points in the waveforms shown in FIGS. 5B to 5D each at every Th×½ interval during an expansion driving period, and have acquired knowledge that the presence of the inflection points is effective for suppressing the residual vibration. Now, a description will be given below of a reason why the presence of the inflection points contributes to suppression of the residual vibration.

In the case where the voltage is increased during a Th×¼ period from the start of driving in the system having the Helmholtz vibration period Th, a restoring force is generated in a direction to contract the capacity during the subsequent Th×¼ period. Specifically, a force that acts on the actuator 104 is switched from a force in a direction to expand the liquid feeding chamber 101 to a force in a direction to contract the liquid feeding chamber 101 whereby a movement of the vibration plate 108 is switched from a movement to project downward to a movement to project upward. Accordingly, it is thought that restorative vibration can be effectively suppressed by applying the force in the opposite direction to each movement at the aforementioned switch timing (namely, at the time of each inflection point).

If the above-mentioned hypothesis is true, then the effect to suppress the restorative vibration can be expected even by using a simpler voltage waveform. To be more precise, in a rising period to increase the voltage to a target voltage from the start of driving, it is only necessary to increase the voltage first from an initial voltage to a predetermined value and then to raise the voltage further to the target voltage by applying a voltage having an absolute value of a gradient smaller than an absolute value of a gradient at the start of driving.

FIGS. 6A to 6D are graphs showing examples of relatively simple waveforms that satisfy the aforementioned conditions. Each of these waveforms satisfies the aforementioned conditions so that the waveform can achieve the effect of suppressing the restorative vibration. Note that the gradient of each of the waveforms shown in FIGS. 6A to 6D may be slightly increased or slightly decreased once after the voltage almost reached the target value. Meanwhile, in each of FIGS. 6A to 6D, the rising period to increase the voltage from the initial voltage to the target voltage is set to Th/2. However, the rising period may be set in a range from about Th×(½−⅛) to Th×(½+¼). For example, the rising period is close to Th/2 in the case of a stepped waveform shown in FIG. 6A. Meanwhile, the rising period is larger than Th/2 in the case of a ramp-shaped waveform shown in FIG. 6B. An upper limit of this range is set to Th×(½+¼) in consideration of actual use.

Figure 6A:
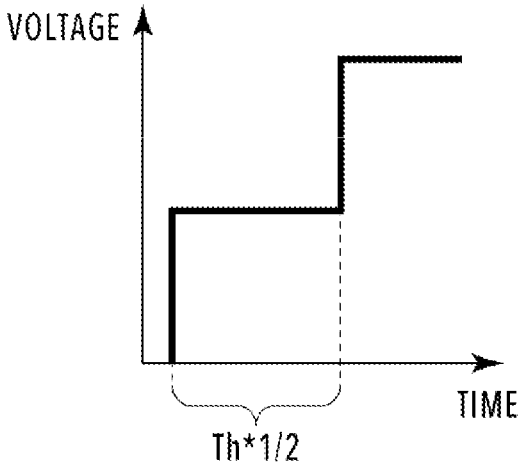
FIGS. 6A to 6D are graphs showing examples of simple waveforms.
Figure 6C:
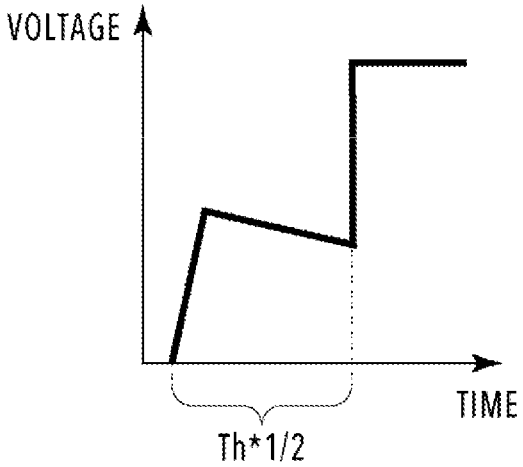
Figure 6B:
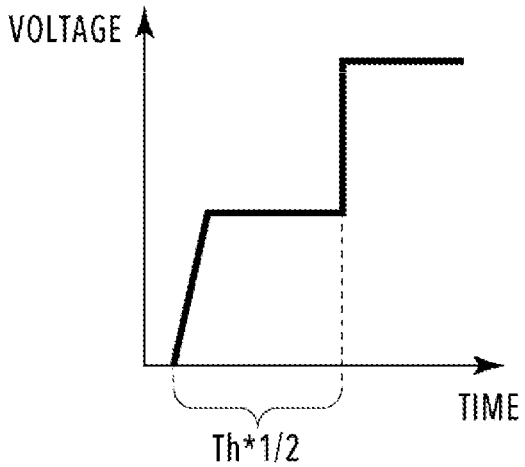
Figure 6D:
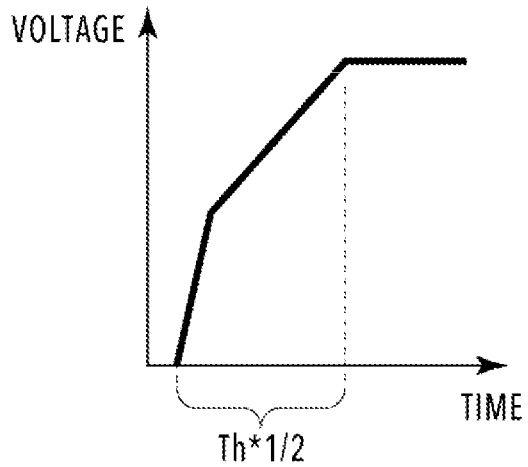
Figure 7A:
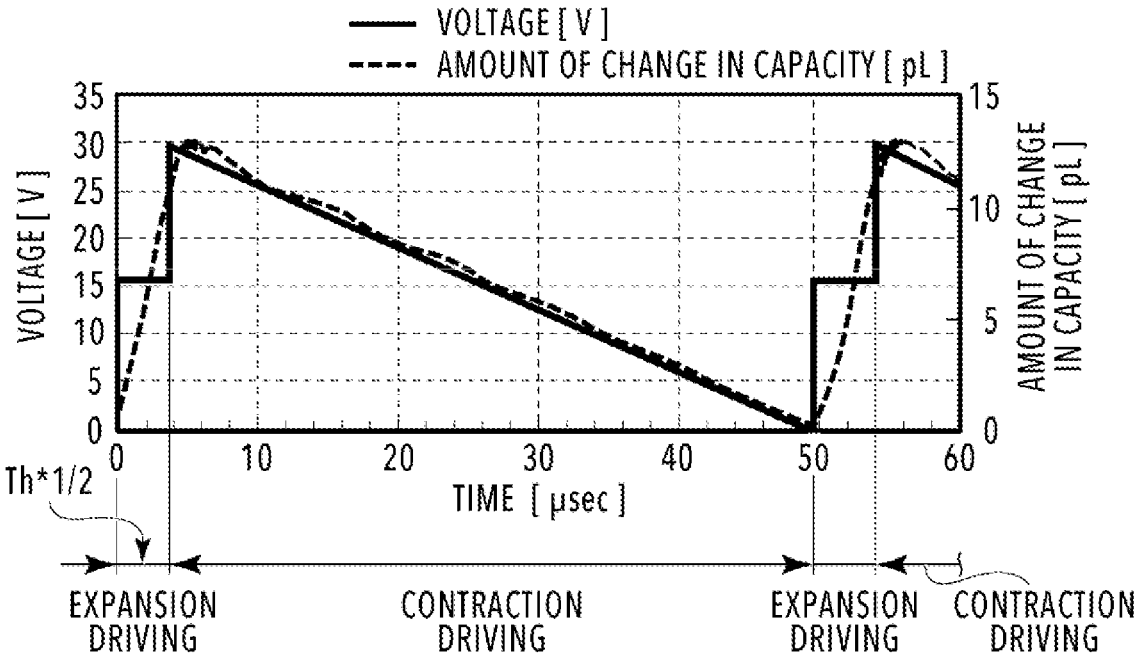
FIGS. 7A and 7B are graphs showing results of simulation in a case of using stepped waveforms.
Figure 7B:
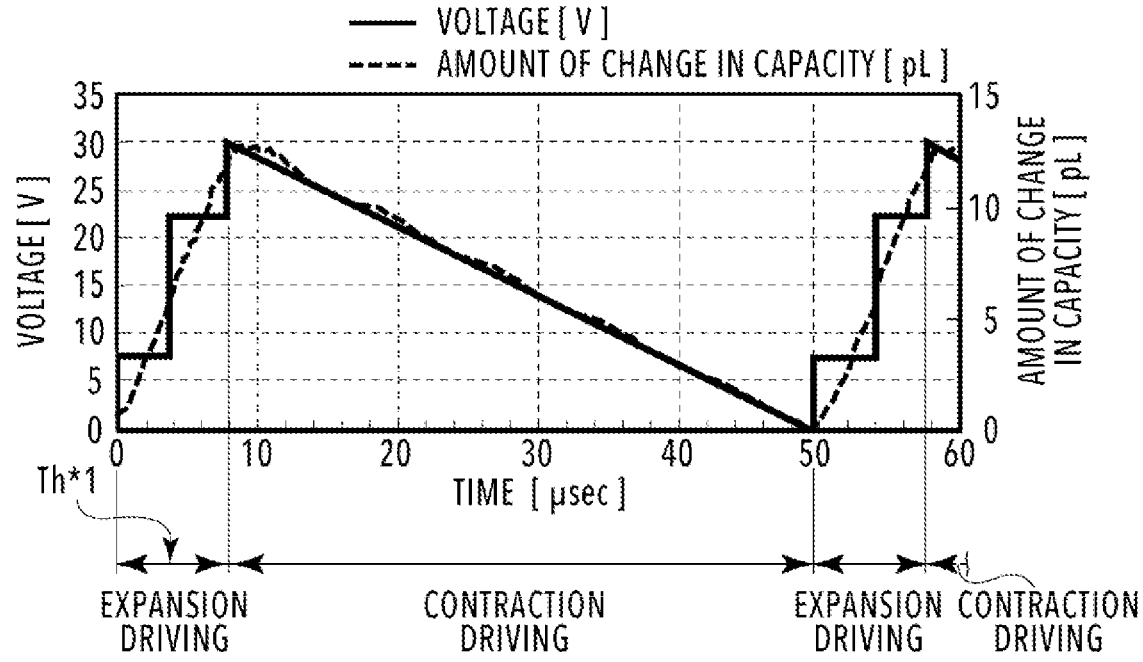

FIGS. 7A and 7B are graphs showing results of simulation in the case of adopting a stepped waveform as shown in FIG. 6A. In each of FIGS. 7A and 7B, the DC-BIAS at −30 V or below is applied, for example. However, illustration of this voltage is omitted therein. FIG. 7A corresponds to a simplified form of the waveform in FIG. 5B in which a single stepped form is put into the expansion driving period (Th×½). On the other hand, FIG. 7B corresponds to a simplified form of the waveform in FIG. 5D in which a double stepped form is put into the expansion driving period (Th×1). In each case, the residual vibration slightly overlaps the amount of change in capacity at the time of contraction driving. Nonetheless, the amplitude is significantly suppressed as compared to the comparative example shown in FIG. 5A.

In FIG. 7A, a voltage (hereinafter referred to as a retained voltage) corresponding to a flat portion in the stepped form is set to a half (15 V) of the target voltage. However, the retained voltage is not limited to this value. For example, the effect of suppressing the amplitude of the residual vibration will be improved further by setting the retained voltage lower than 15 V. However, setting the retained voltage too low may cause a failure to obtain a sufficient flow velocity as the prepared voltage (30 V) is not fully used for the expansion driving, and may therefore result in deterioration in liquid feeding efficiency. For this reason, the retained voltage needs to be adjusted such that both of the purpose to suppress the residual vibration and a purpose to exert a fluid valve function are achieved with an appropriate balance. As a result of studies conducted by the inventors, it was confirmed that the retained voltage would preferably be set about 0.40 times to 0.95 times as high as the target voltage.

Meanwhile, in FIG. 7B, a first retained voltage is set 0.25 times as high as the target voltage while a second retained voltage is set 0.75 times as high as the target voltage. However, the retained voltages are not limited to these values. These two retained voltages may be adjusted to appropriate values, respectively, on the same grounds as those explained with reference to FIG. 7A. As a result of studies conducted by the inventors, it was confirmed that the first retained voltage would preferably be set about 0.20 times to 0.475 times as high as the target voltage and the second retained voltage would preferably be set about 0.70 times to 0.975 times as high as the target voltage.

Next, a description will be given of allocation of a driving waveform period for the expansion driving and a driving waveform period for the contraction driving. The driving waveform period for the expansion driving needs to maintain a high flow velocity enough for achieving the fluid valve function. For this reason, the period for the expansion driving may be set as appropriate based on the target voltage value and the flow velocity that needs to be brought about. As for the driving waveform period for the contraction driving, there is no advantage to further slowing down the flow velocity of the liquid as long as a small-vibration and low-velocity flow is available. Such an excessive reduction in velocity will prolong a driving period and end up in deterioration in liquid feeding efficiency per unit time period on the contrary. On the other hand, if the driving waveform period for the contraction driving is too short relative to the driving waveform period for the expansion, the impact of the residual vibration developed at the time of expansion is increased at the time of contraction, thereby deteriorating the liquid feeding efficiency. In view of the above, it is preferable to set the driving waveform period for the contraction driving in a range from equal to or above 3 times to equal to or below 100 times of the driving waveform period for the expansion driving.

There is a case where a waveform having a steep gradient with a period of 1 μsec, for instance, is used as a waveform for rapid expansion driving. For example, in the case of performing repeated operations each in a 10-kHz cycle including a driving waveform of 1 μsec for the rapid expansion driving and a driving waveform of 99 μsec for the flow contraction driving, the driving waveform period for the contraction driving is 99 times as long as the driving waveform period for the expansion driving. It was confirmed that the rapid expansion driving would bring about an imperfect response but might result in improvement in liquid feeding efficiency in some cases. In this regard, it is preferable to take account of setting the driving waveform period for the contraction driving equal to or below 100 times as long as the driving waveform period for the expansion driving at the maximum. Moreover, as a result of studies conducted by the inventors, it was confirmed that the driving waveform period for the contraction driving was most preferably set about 10 times as long as the driving waveform period for the expansion driving within the aforementioned range.

For example, assuming that the period for the expansion driving is set to 4 μsec and the period for the contraction driving is set to 46 μsec in a state of fixing the driving period to 50 μsec, a ratio (period for contraction driving)/(period for expansion driving) turns out to be around 11.5, which satisfies the aforementioned condition.

Note that the Helmholtz period Th of the liquid feeding apparatus needs to be equal to or below 25 μsec in order to set the period for the contraction driving 3 times or more than the period for the expansion driving in the state of setting the driving period of the actuator 104 to 50 μsec as seen in this embodiment.

Here, with reference to FIG. 2A again, it is apparent that the waveform of the first embodiment indicated with the solid line in FIG. 2A satisfies the conditions described above. Specifically, the value of the applied voltage is first increased from 0 V to the retained voltage of 25 V in the expansion driving period (from 0.0 μsec to 5.4 μsec) for increasing the voltage value up to the target voltage of 30 V. Next, the voltage at 25 V is applied at the absolute value (0) of the gradient smaller than the absolute value (25 V/2.1 μsec) of the gradient at the start of the driving. Then, the voltage is further increased up to the target voltage of 30 V. In this case, the retained voltage (25 V) is about 0.8 times as high as the target voltage (30 V). The value of this ratio falls within the range from 0.4 times to 0.95 times.

As described above, according to this embodiment, the voltage is applied to the actuator 104 in such a way as to repeat the period for increasing the voltage from a reference voltage to the target voltage in a short time and the period for decreasing the voltage from the target voltage to the reference voltage in a long time. Then, during the period for increasing the voltage up to the target voltage, the voltage is first increased to the predetermined value lower than the target voltage and then the voltage is further increased to the target voltage by applying the voltage having the absolute value of the gradient lower than the absolute value of the gradient at the start of the driving. Even in the case of occurrence of the residual vibration having the Helmholtz frequency, the above-mentioned control can relax the change in capacity of the liquid feeding chamber associated with the residual vibration, thereby improving the liquid feeding efficiency of the liquid feeding apparatus as a whole.

Second Embodiment

Figure 8A:
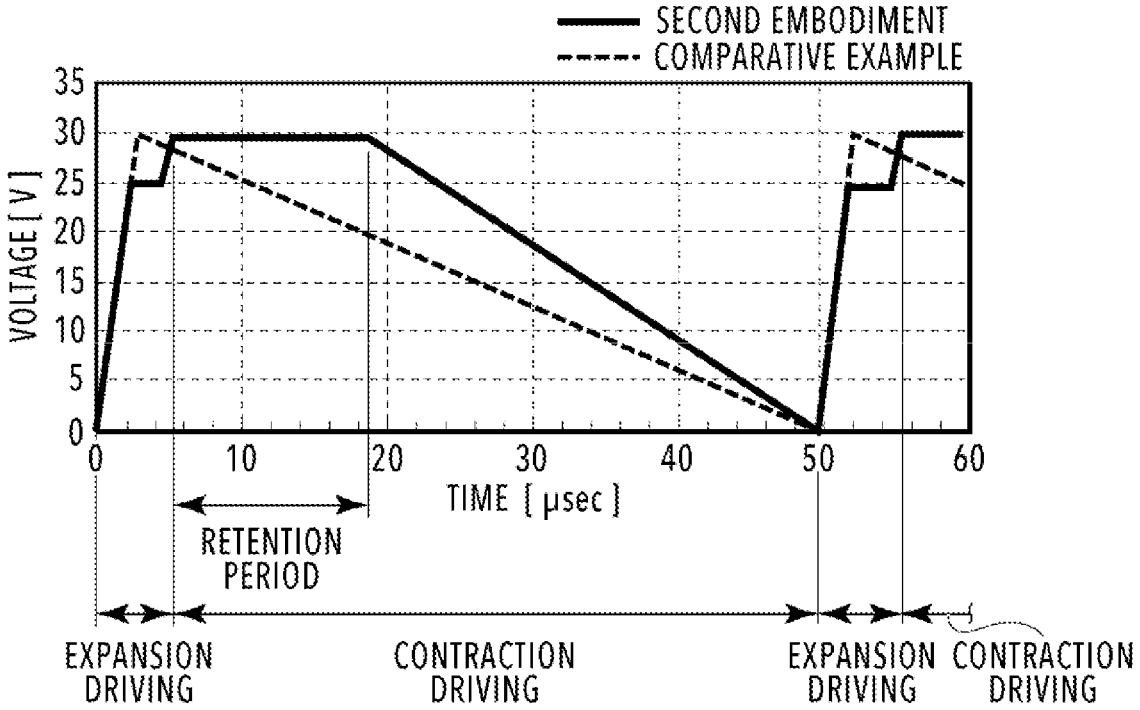
FIGS. 8A and 8B are graphs showing applied voltages and amounts of change in capacity of a liquid feeding chamber according to a second embodiment.
Figure 8B:
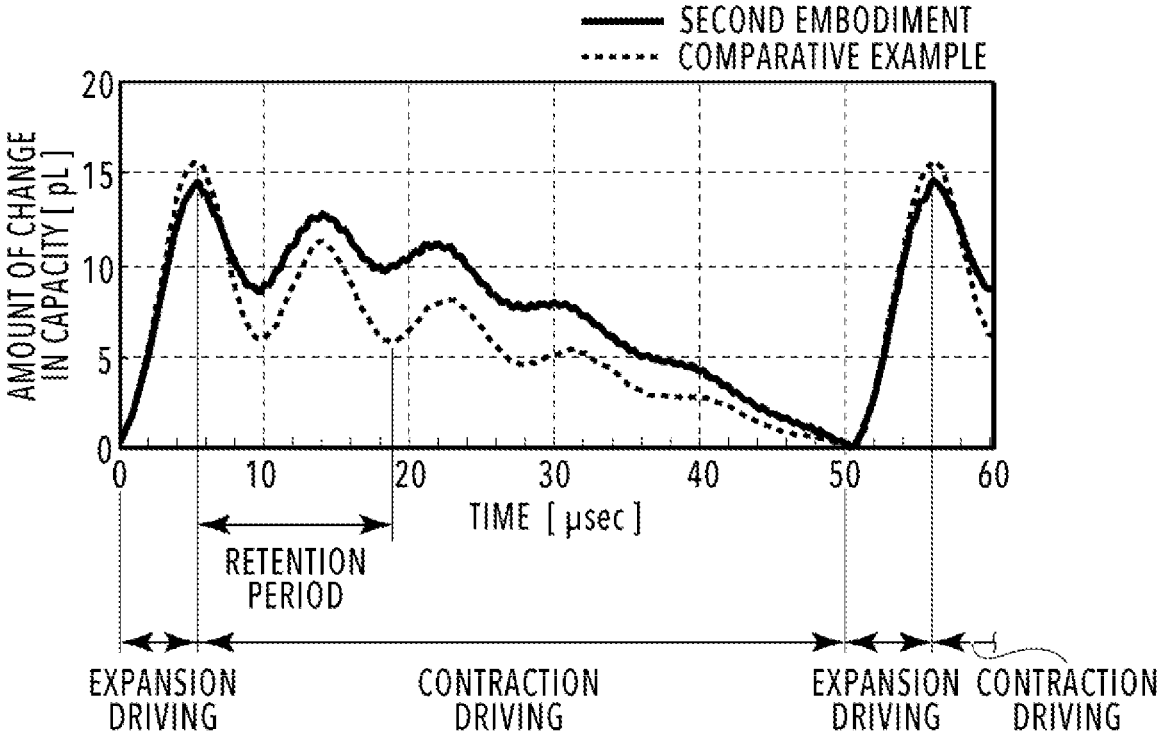

The liquid feeding apparatus described with reference to FIGS. 1A and 1B is assumed to be used in a second embodiment as well. FIGS. 8A and 8B are graphs showing voltages applied to the actuator 104 and amounts of change in capacity of the liquid feeding chamber 101 to be increased and decreased by the voltages in the second embodiment, which are depicted as with FIGS. 2A and 2B explained in the first embodiment. In FIG. 8A, the DC-BIAS at −30 V or below is applied, for example. However, illustration of this voltage is omitted therein. The comparative example is similar to that in the first embodiment.

The second embodiment is different from the first embodiment in that a "retention period" is defined in the "contraction driving" period. Specifically, in the second embodiment, the voltage is increased to the target voltage in the same manner as the first embodiment, then the target voltage is retained for a period from time t=5.4 μsec to 19.9 μsec, and then the voltage is decreased at a constant gradient and brought back to the original voltage at time t=50.0 μsec as shown in FIG. 8A.

FIG. 8B is a graph showing the amount of change in capacity of the liquid feeding chamber 101 in the case of applying the voltage as shown in FIG. 8A. In the second embodiment as well, the capacity is significantly increased during a period from the start of driving at time t=0.0 μsec to time t=5.0 μsec. Then, the amplitude is gradually reduced while repeating the increase and decrease associated with the residual vibration along the drop in voltage, and the value of the voltage returns to the original value (the amount of change in capacity of 0). In FIG. 8B, the period in which the capacity of the liquid feeding chamber 101 is basically expanded is indicated as the "expansion driving", the period in which the capacity is basically contracted is indicated as the "contraction driving", and the period within the "contraction driving" period in which the target voltage of 30 V is retained is indicated as the "retention period".

It is apparent that the second embodiment also reduces the amplitude as compared to the comparative example indicated with the dashed line. Moreover, as compared to the amount of change in capacity of the first embodiment shown in FIG. 2B, it is apparent that the second embodiment retains the substantial amount of change in capacity relative to the default state as a whole.

Figure 9A:
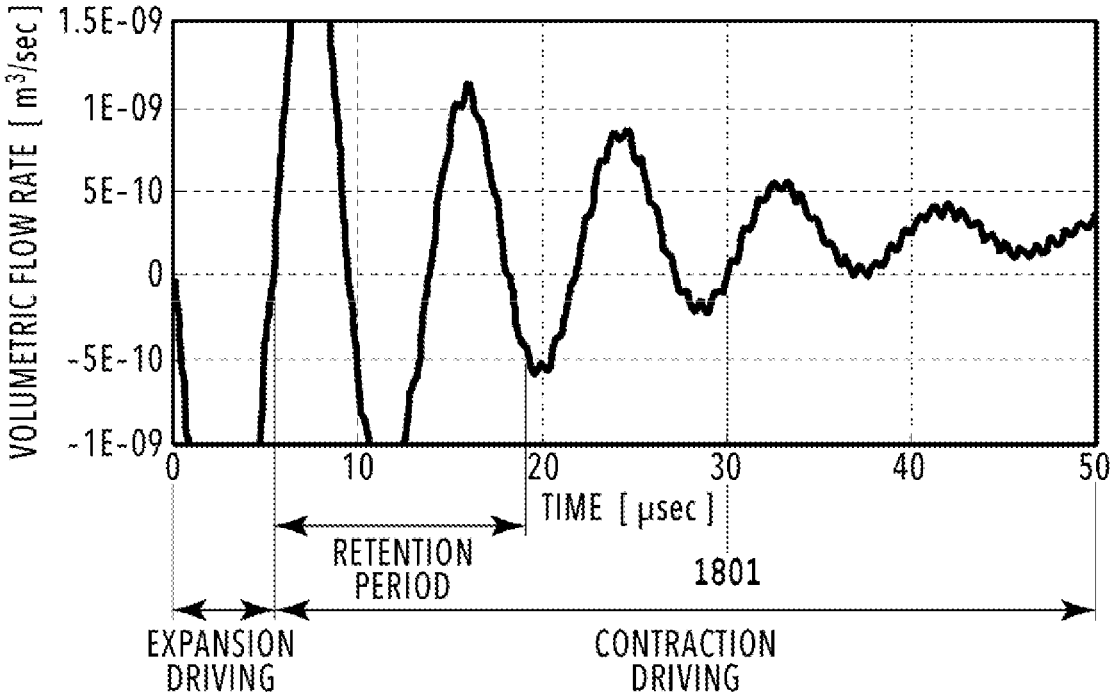
FIGS. 9A and 9B are graphs showing results of volumetric flow rates obtained with a simulator.
Figure 9B:
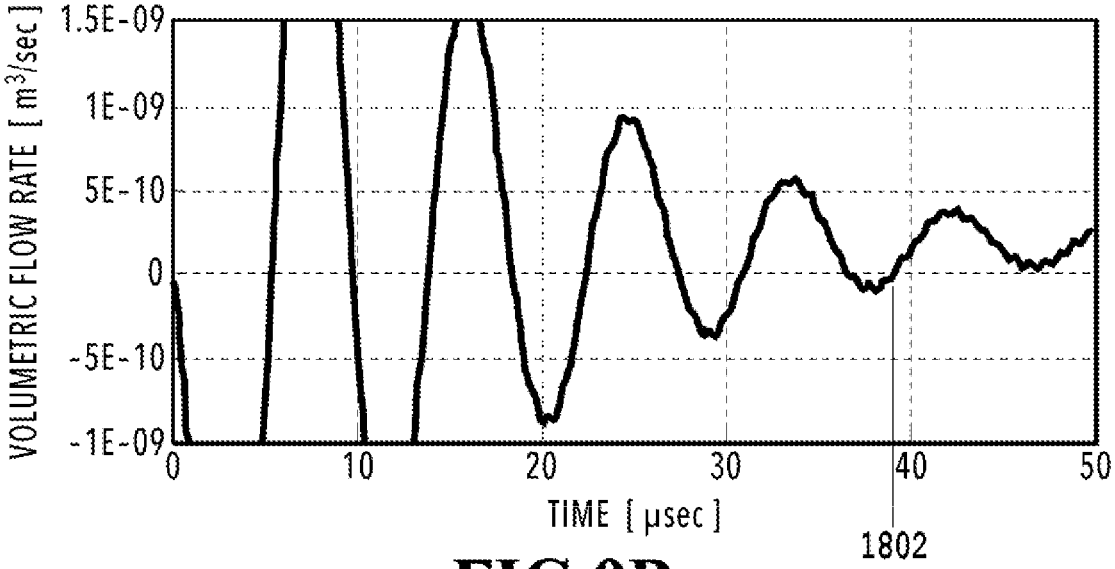

FIGS. 9A and 9B are graphs showing results of volumetric flow rates in the second connection flow channel 102 which are obtained with a simulator. FIG. 9A shows the case of the second embodiment while FIG. 9B shows the case of the comparative example. In each of FIGS. 9A and 9B, the horizontal axis indicates the time while the vertical axis indicates the volumetric flow rate. The volumetric flow rate corresponds to a moving velocity of the volume ($m^3$/sec). Here, a positive value indicates that the liquid is moving in the +X direction while a negative value indicates that the liquid is moving in the −X direction. Each of FIGS. 9A and 9B illustrates an enlarged part of the graph so as to facilitate the understanding of the difference.

In comparison of FIG. 9A with FIG. 9B, the volumetric flow rate in each case is displaced between a positive region and a negative region for some time after the start of driving (t=0.0 μsec) and the entire region of the amplitude is eventually included in the positive region. The event in which the entire region of the amplitude is included in the positive region means that the liquid moves only in the +X direction and contains no velocity components in directions leading to losses. Here, assuming that a timing at which the entire region of the amplitude is included in the positive region is referred to as threshold timing, the threshold timing in FIG. 9A is time t≈30.0 μsec and the threshold timing in FIG. 9B is time t≈40.0 μsec. Accordingly, the earlier threshold timing in the second embodiment represents higher liquid feeding efficiency than that of the comparative example.

The above-mentioned threshold timing, that is, the liquid feeding efficiency can be adjusted by use of the length of the retention period. As a result of studies conducted by the inventors, it was confirmed that the liquid efficiency corresponding to the retention period had its maximum value and an appropriate range of the retention period would preferably be set about 1.0 times to 2.5 times as long as the Helmholtz period unique to the system. If the retention period is set more than 2.5 times of the unique period, the period for contraction comes close to the period for expansion, and the function to move the liquid to the predetermined direction by using the difference in flow velocity cannot be fully obtained. On the other hand, the retention period also has an impact on structural designs and voltage conditions of the liquid feeding apparatus. From this point of view, it is preferable to set the retention period in a range from about (¼−⅛)×Th to (10+⅛)×Th.

As a result of studies conducted by the inventors, it was confirmed that the flow velocity at the time of feeding the liquid in the second embodiment was about 1.8 times as fast as the flow velocity in the comparative example. Moreover, it was confirmed that the liquid feeding amount per period was about 0.7 pL and the liquid feeding efficiency was about 4.5% in the comparative example whereas the liquid feeding amount per period was about 1.3 pL and the liquid feeding efficiency was about 8.5% in the second embodiment. This result means that the second embodiment can reduce the loss in the liquid feeding amount more than the comparative example and can improve the liquid feeding efficiency as the liquid feeding apparatus by about 1.9 times. Moreover, even in the case of using the same liquid feeding apparatus, the second embodiment further improves the liquid feeding efficiency as compared to the first embodiment.

Figure 10:
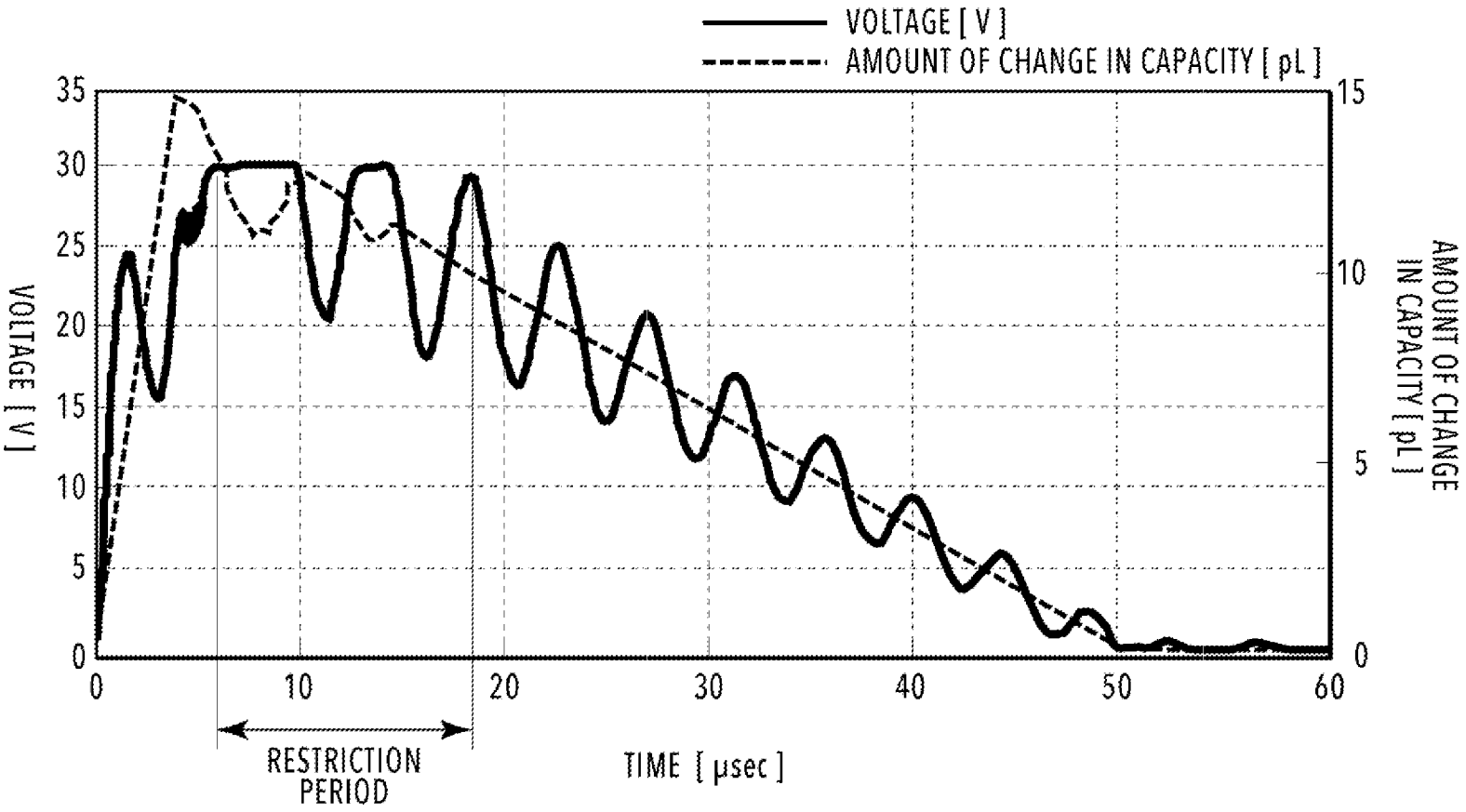
FIG. 10 is a graph showing an example of a waveform of a voltage to be applied to an actuator.

FIG. 10 shows an example of the waveform of the voltage to be applied to the actuator 104 and a change in capacity in the case of applying the voltage waveform, which are obtained by using the simulator in order to realize the change in capacity shown in FIG. 4A. This example obtains the data basically by using the same conditions as those applied to FIG. 5B except that the maximum value of the amount of change in capacity is increased from 12 pL to 15 pL. In the case where the maximum value of the amount of change capacity is increased, it is possible to realize the change in capacity as indicated with the dashed line in FIG. 5B by using a voltage waveform having a substantially similar shape to that in FIG. 5A if the maximum value of the voltage can be increased to about 35 V in accordance with the increase in the maximum value.

However, the maximum voltage acceptable to the liquid feeding apparatus of this embodiment is 30 V. Accordingly, it is not possible to apply the voltage waveform having the similar shape to that in FIG. 5A. Hence, a portion of the voltage originally in excess of 30 V may be replaced with a voltage at 30 V as in FIG. 10. In FIG. 10, a period where the original voltage is replaced with the voltage at 30 V is indicated as a "restriction period". Moreover, in the case of applying the voltage having the aforementioned waveform, the amount of change in capacity of the liquid feeding chamber traces a dashed line indicated in FIG. 10. In comparison with the amount of change in capacity indicted with the dashed line in FIG. 5B, some overlap of the residual vibration is observed in the "restriction period". Nonetheless, this residual vibration appears in part of the "restriction period" only and the residual vibration having the Helmholtz period is suppressed outside the "restriction period" thanks to the increase and decrease in voltage. According to the simulation, it was confirmed that the liquid feeding amount per period was about 2.0 pL and the liquid feeding efficiency was about 13.0%. In other words, even if the "restriction period" is defined due to the upper limit value of the voltage, it is still possible to improve the liquid feeding efficiency as a result of conducting the driving based on the voltage waveform created based on the voltage value exceeding the maximum voltage value as shown in FIG. 5B. In this case, the "retention period" of the second embodiment shown in FIG. 8A is interpreted as the "restriction period" shown in FIG. 10, so that the second embodiment can be deemed to be subjected to simplification of the waveform under the same conditions as those of the first embodiment.

As described above, according to this embodiment, the voltage is applied to the actuator 104 in such a way as to repeat the period for increasing the voltage from the reference voltage to the target voltage in a short time and the period for decreasing the voltage from the target voltage to the reference voltage in a long time. Then, during the period for increasing the voltage up to the target voltage, the voltage is first increased to the predetermined value lower than the target voltage and then the voltage is further increased to the target voltage by applying the voltage having the absolute value of the gradient lower than the absolute value of the gradient at the start of the driving. In the meantime, during the period for decreasing the voltage, the target voltage is retained for some time and then the voltage is changed into the reference voltage at the constant gradient. Even in the case of occurrence of the residual vibration having the Helmholtz frequency, the above-mentioned control can relax the change in capacity of the liquid feeding chamber associated with the residual vibration, thereby improving the liquid feeding efficiency of the liquid feeding apparatus as a whole.

Third Embodiment

Figure 11:
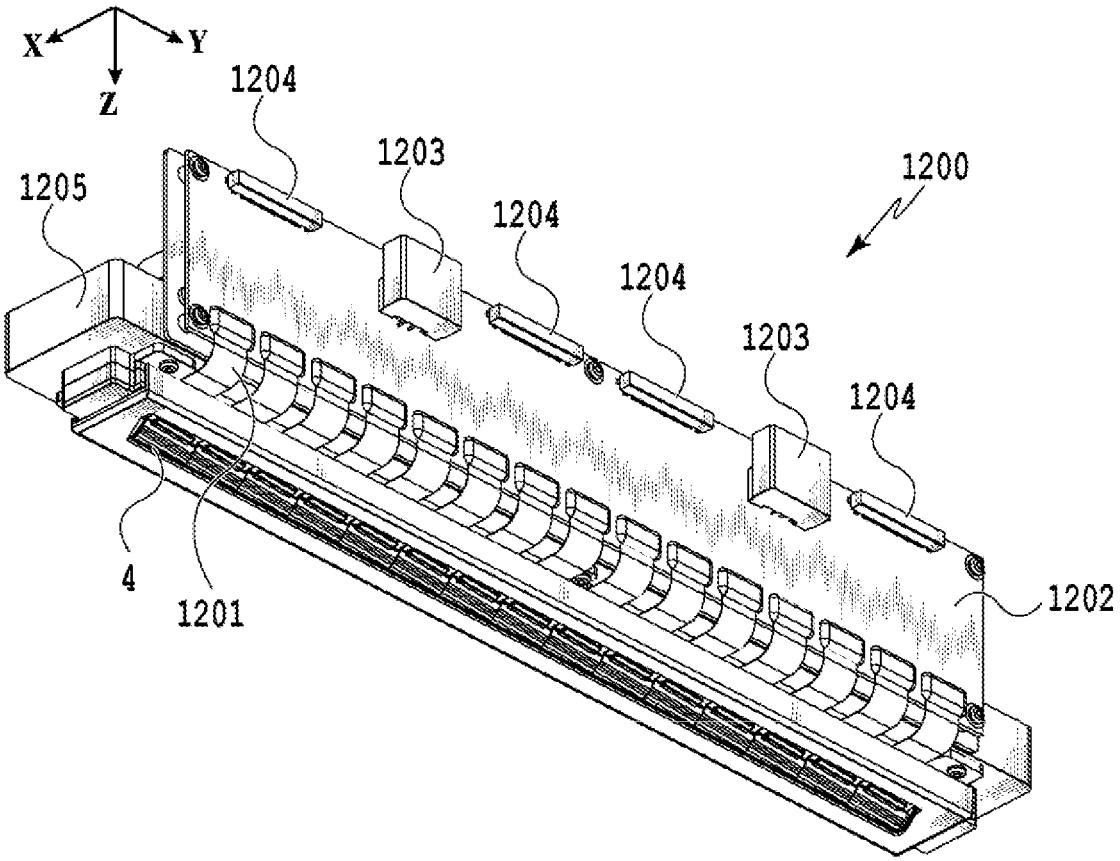
FIG. 11 is a perspective view of an inkjet printing head.

FIG. 11 is a perspective view of a liquid ejection head 1200 (hereinafter also referred to as an inkjet printing head) that can be used as the liquid feeding apparatus of this disclosure. The inkjet printing head 1200 is formed by arranging element boards 4 in the Y direction. Here, each element board 4 includes ejection elements arranged in the Y direction. FIG. 11 illustrates the inkjet printing head 1200 of a full-line type in which the element boards 4 are arranged in the Y direction over a length corresponding to the width of the A4 size.

The respective element boards 4 are connected to the same electric wiring board 1202 through flexible wiring boards 1201. The electric wiring board 1202 is equipped with power supply terminals 1203 for receiving electric power and signal input terminals 1204 for receiving ejection signals. Meanwhile, circulation flow channels for forwarding an ink containing a coloring material and being supplied from a not-illustrated ink tank to the respective element boards 4 and collecting the ink not used for printing are formed in an ink supply unit 1205.

In this configuration, the respective ejection elements arranged in the element boards 4 eject the ink supplied from the ink supply unit 1205 in the Z direction of FIG. 11 based on printing data inputted from the signal input terminals 1204 and by using the power supplied from the power supply terminals 1203.

Figure 12A:
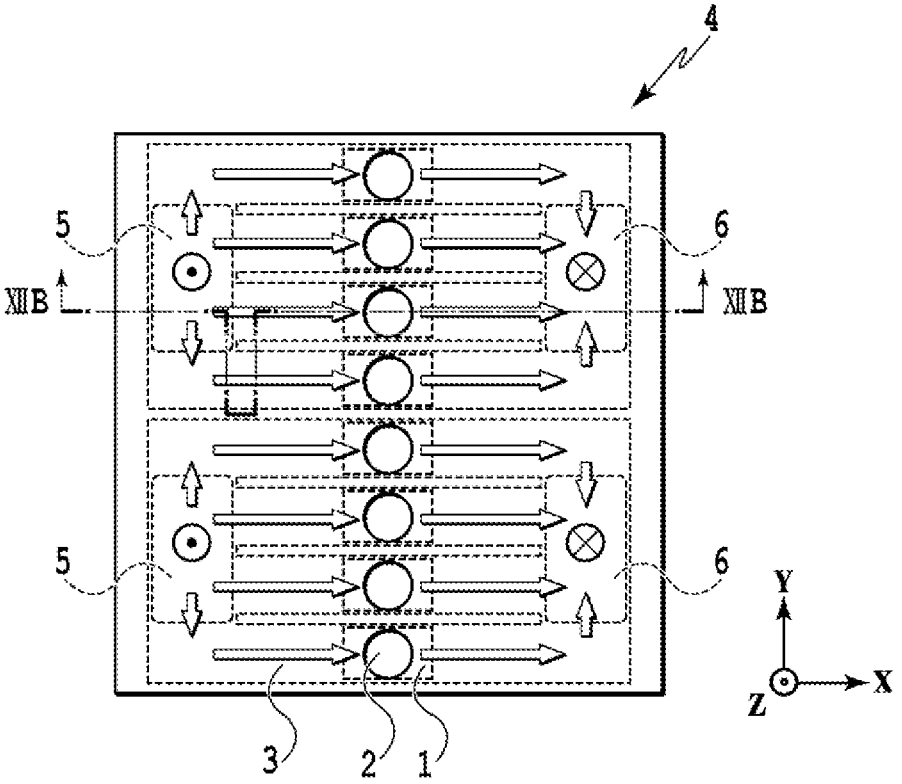
FIGS. 12A and 12B are diagrams showing a flow channel configuration of a flow channel block.
Figure 12B:
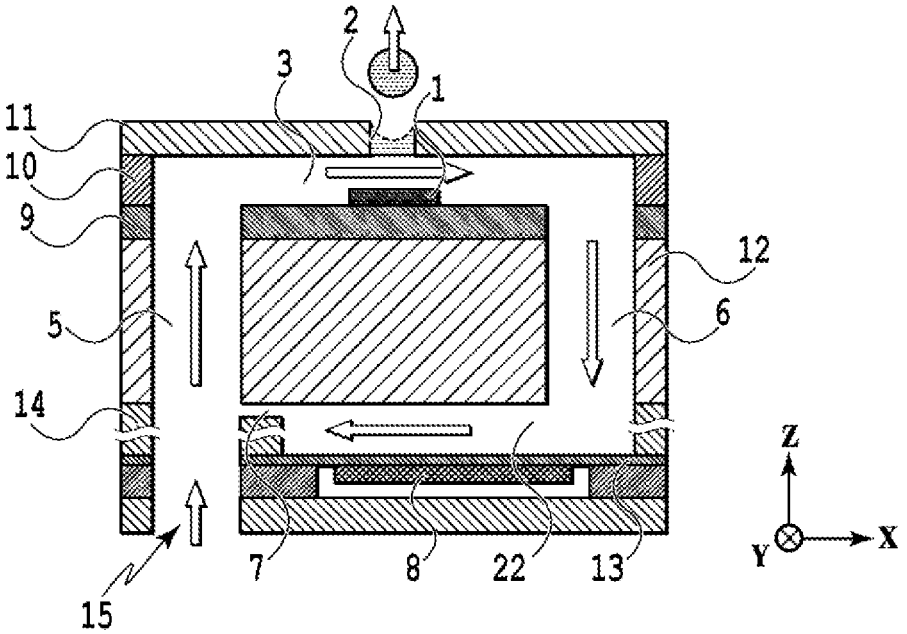

FIGS. 12A and 12B are diagrams showing a flow channel configuration of one flow channel block in the element board 4. Two or more flow channel blocks are formed in each element board 4. FIG. 12A is a transparent view of one of the flow channel blocks viewed from an opposite side (+Z direction side) to an ejection port surface. Meanwhile, FIG. 12B is a cross-sectional view taken along the XIIB-XIIB line in FIG. 12A.

As shown in FIG. 12A, each flow channel block includes eight ejection ports 2 arranged in the Y direction, eight pressure chambers 3 prepared in such a way as to communicate with the respective ejection ports, two supply flow channels 5, and two collection flow channels 6. Moreover, each of the two supply flow channels 5 supplies the ink to four of the pressure chambers 3 in common while each of the two collection flow channels 6 collects the ink from four of the pressure chambers 3 in common. Each flow channel block is provided with one liquid feeding mechanism 8 to be described later.

As shown in FIG. 12B, each element board 4 of this embodiment is formed by stacking a second substrate 13, an intermediate layer 14, a first substrate 12, a functional layer 9, a flow channel forming member 10, and an ejection port forming member 11 in the Z direction in this order. An energy generation element 1 serving as an electrothermal conversion element is disposed on a surface of the functional layer 9 while the ejection port 2 is formed at a position in the ejection port forming member 11 corresponding to the energy generation element 1. The flow channel forming member 10 interposed between the functional layer 9 and the ejection port forming member 11 is provided as a partition wall between every two energy generation elements 1 arranged in the Y direction, thus constituting each pressure chamber 3 corresponding to each energy generation element 1 and to each ejection port 2.

The ink in a stable state stored in the pressure chamber 3 forms a meniscus at the ejection port 2. In the case where a voltage pulse is applied to the energy generation element 1 in accordance with an ejection signal, the ink in contact with the energy generation element 1 causes film boiling, and the ink is ejected as a droplet in the Z direction from the ejection port 2 by using growth energy of a bubble thus generated. Assuming that the direction (which is the Z direction in this case) to eject the liquid from the ejection port 2 is a direction from below to above, the ink is ejected from below to above. In actual ink ejection, the ink may be ejected from above to below in the direction of gravitational force. In this case, an upper side with respect to the direction of gravitational force corresponds to "below" and a lower side with respect to the direction of gravitational force corresponds to "above."

The ink in an amount equivalent to that consumed as a result of an ejecting operation is supplied anew to the pressure chamber 3 by means of capillary forces of the pressure chamber 3 and the ejection port 2, whereby the meniscus is formed again at the ejection port 2. Note that the combination of the ejection port 2, the energy generation element 1, and the pressure chamber 3 will be referred to as an ejection element in this embodiment.

As shown in FIG. 12B, in the element board 4 of this embodiment, circulation flow channels are formed by using the second substrate 13, the intermediate layer 14, first substrate 12, the functional layer 9, the flow channel forming member 10, and the ejection port forming member 11 as walls, respectively. Here, the circulation flow channels can be categorized into the supply flow channel 5, the pressure chamber 3, the collection flow channel 6, a liquid feeding chamber 22, and a connection flow channel 7.

The pressure chamber 3 is prepared for each ejection element. The supply flow channel 5 and the collection flow channel 6 are prepared for four of the ejection elements in the block. Each supply flow channel 5 supplies the ink to four of the pressure chambers 3 in common while each collection flow channel 6 collects the ink from four of the pressure chambers 3 in common.

Each liquid feeding chamber 22 and each connection flow channel 7 are prepared for every eight ejection elements, that is, for each flow channel block. The liquid feeding chamber 22 is arranged at such a position that overlaps the eight energy generation elements 1 on the XY plane. The liquid feeding chamber 22 is equipped with the liquid feeding mechanism 8 that can change a capacity of the liquid feeding chamber 22. The liquid feeding mechanism 8 circulates the ink in the eight pressure chambers 3 in common. The connection flow channel 7 is disposed almost at the center of the flow channel block in the Y direction and connects the liquid feeding chamber 22 to the supply flow channel. A position of the supply flow channel to be connected to the connection flow channel 7 is a position located upstream of a point where the supply flow channel is branched into the two supply flow channels 5.

Based on the above-described configuration, the ink supplied through a supply port 15 can be circulated to the supply flow channels 5, the pressure chambers 3, the collection flow channels 6, the liquid feeding chamber 22, and the connection flow channel 7 in this order by appropriately driving the liquid feeding mechanism 8. This circulation is conducted stably irrespective of the presence or the frequency of the ejecting operation so that the fresh ink can be constantly supplied to the vicinity of each ejection port 2. Though not illustrated in the drawings, it is preferable to provide a filter in the middle of the supply flow channel 5 in front of each pressure chamber 3 so as to prevent foreign substances, bubbles, and the like from flowing in. A columnar structure or the like can be adopted as such a filter.

The element board 4 can be manufactured by forming the structures in the first substrate 12 and the second substrate 13 in advance, respectively, and then attaching the first substrate 12 and the second substrate 13 to each other while interposing the intermediate layer 14 that includes a groove at a location serving as the connection flow channel 7 later as shown in FIG. 12B.

Now, a specific example of dimensions in the above-described structures will be described below. In this embodiment, the respective ejection elements, namely, the energy generation elements 1, the ejection ports 2, and the pressure chambers 3 are arranged at a density of 1200 npi (nozzles per inch) in the Y direction. The size of each energy generation element 1 is set to 20 μm×20 μm. A diameter of each ejection port 2 is set to 18 μm. A thickness of the ejection port 2, namely, a thickness of the ejection port forming member 11 is set to 5 μm. The size of each pressure chamber 3 is set to 100 μm in the X direction (length)×37 μm in the Y direction (width)×5 μm in the Z direction (height). Incidentally, the ink used therein has a viscosity of 2 cps and an ink ejection amount from each ejection port is set to 2 pL.

In this embodiment, a driving frequency of each energy generation element 1 is set to 15 kHz. This driving frequency is set up based on a time period required for a sequence including application of a voltage to the energy generation element 1, actual ejection of the ink, and refilling of each ejection element with the new ink in order to enable the next ejecting operation.

Meanwhile, in the element board 4 of this embodiment, the size of the liquid feeding chamber 22 is set to 250 μm in the X direction×120 μm in the Y direction×250 μm in the Z direction. The size of the connection flow channel 7 is set to 25 μm in the X direction×25 μm in the Y direction×25 μm in the Z direction.

This embodiment is designed to satisfy the relations of dimensions described above so as to set flow channel resistance and inertance of the connection flow channel 7 lower than flow channel resistance and inertance of a flow channel including a combination of the supply flow channels 5, the collection flow channels 6, and the pressure chambers 3. Here, the "flow channel resistance and inertance of the flow channel including a combination of the supply flow channels 5, the collection flow channels 6, and the pressure chambers 3" represents an aggregate of a sum of respective parallel flow channel resistance values of the two supply flow channels 5, the eight pressure chambers 3, and the two collection flow channels 6 and a sum of respective serial flow channel resistance values thereof. Note that the above-mentioned values of the dimensions of the respective components constitute a mere example and may therefore be changed as appropriate depending on the specifications required therefrom.

Figure 13A:
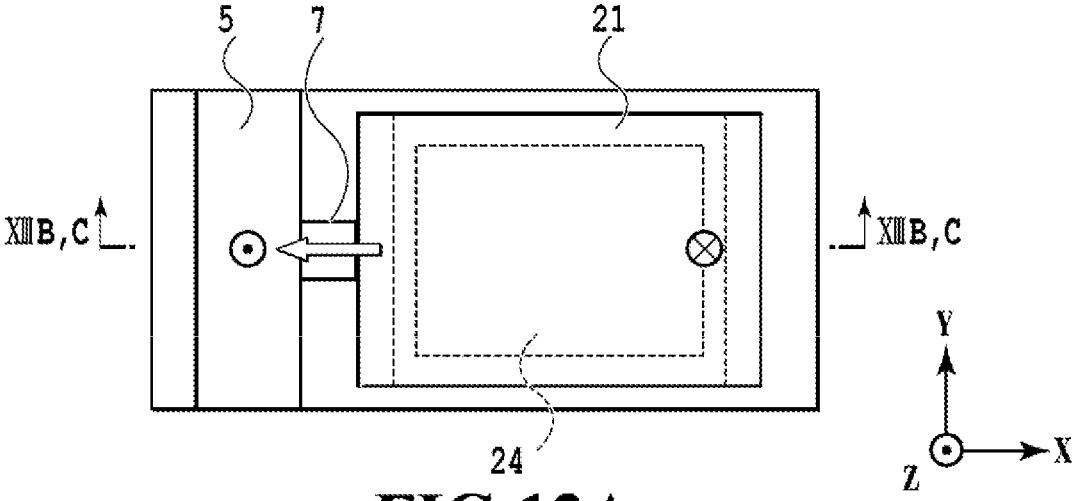
FIGS. 13A to 13C are diagrams for explaining a structure and operations of a liquid feeding mechanism.
Figure 13B:
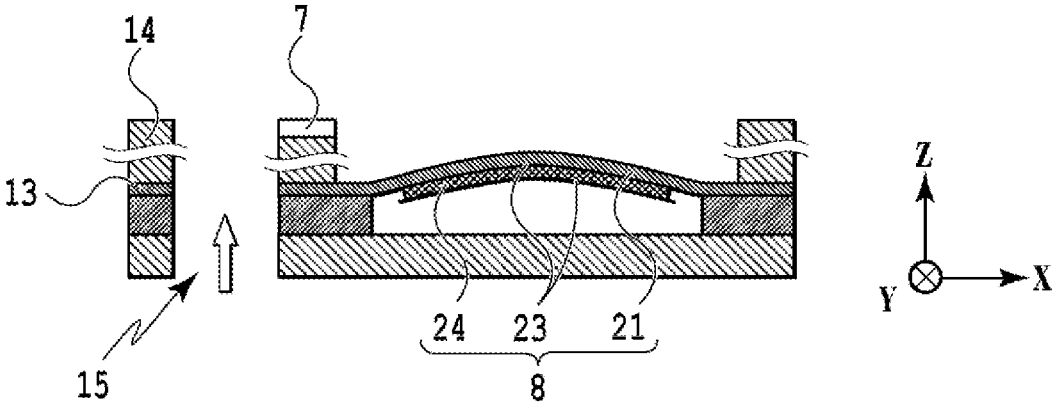
Figure 13C:
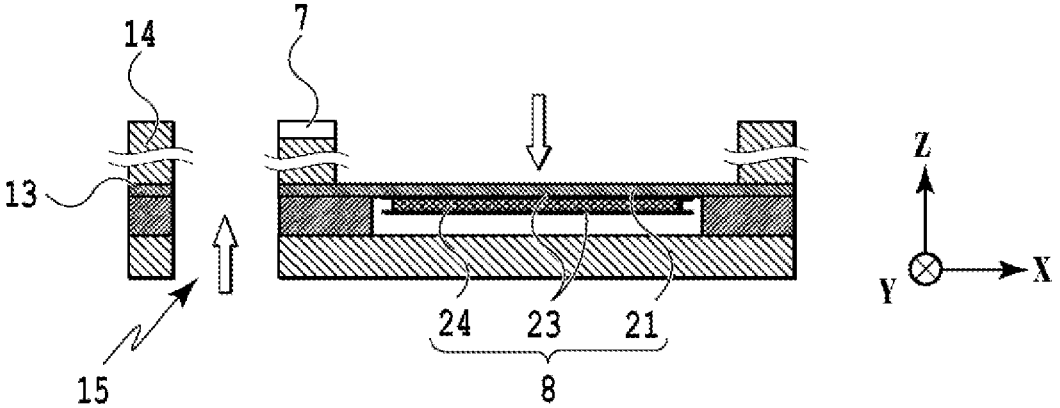

FIGS. 13A to 13C are diagrams for explaining a structure and operations of the liquid feeding mechanism 8. In this embodiment, a piezoelectric actuator which includes a thin-film piezoelectric body 24, two electrodes 23 that sandwich the thin-film piezoelectric body 24 while being located on top and bottom surfaces thereof, and a diaphragm 21 is adopted as the liquid feeding mechanism 8. The liquid feeding mechanism 8 (hereinafter also referred to as an actuator 8) is disposed on the second substrate 13 so as to expose the diaphragm 21 to the liquid feeding chamber 22.

The diaphragm 21 is made of Si or the like having a thickness of about 1 to 2 μm. The thin-film piezoelectric body 24 is a PZT piezoelectric thin film having the dimensions of about 220 μm in the X direction×90 μm in the Y direction×2 μm in the Z direction.

In the case where a voltage is applied to the thin-film piezoelectric body 24 through the two electrodes 23, the diaphragm 21 is deflected together with the thin-film piezoelectric body 24 and the capacity of the liquid feeding chamber 22 is thus changed. In other words, it is possible to change the capacity of the liquid feeding chamber 22 by displacing the diaphragm 21 in the ±Z directions while changing the voltage applied to the two electrodes 23.

FIG. 13B shows a default state in which the DC-BIAS voltage is applied to the thin-film piezoelectric body 24. In the default state, the diaphragm 21 contracts a liquid chamber capacity of the liquid feeding chamber 22. On the other hand, FIG. 13C shows a state in which the liquid chamber capacity is expanded from the default state by applying a transitional waveform at the maximum voltage of 30 V to the thin-film piezoelectric body 24. The diaphragm 21 is displaced between the default state in FIG. 13B and the expanded state in FIG. 13C depending on the magnitude of the voltage applied to the thin-film piezoelectric body 24.

In the inkjet printing head 1200, quality of the ink (the liquid) may be deteriorated at an ejection port not used for an ejecting operation for a while due to a progress in evaporation of a volatile component. Moreover, if the degrees of such evaporation vary among the ejection ports depending on ejection frequencies, amounts of ejection or directions of ejection may also vary whereby unevenness in density or streaks may be observed in a printed image. Given this situation, the inkjet printing head 1200 is required to achieve the high liquid feeding efficiency in order to supply the fresh ink constantly to the vicinity of each ejection port. Now, a description will be given below of liquid feeding control with the inkjet printing head 1200 of this embodiment.

The Helmholtz resonance frequency of each flow channel block of this embodiment is set to about 100 kHz. The actuator 8 is driven by using this resonance frequency in this embodiment.

Figure 14:
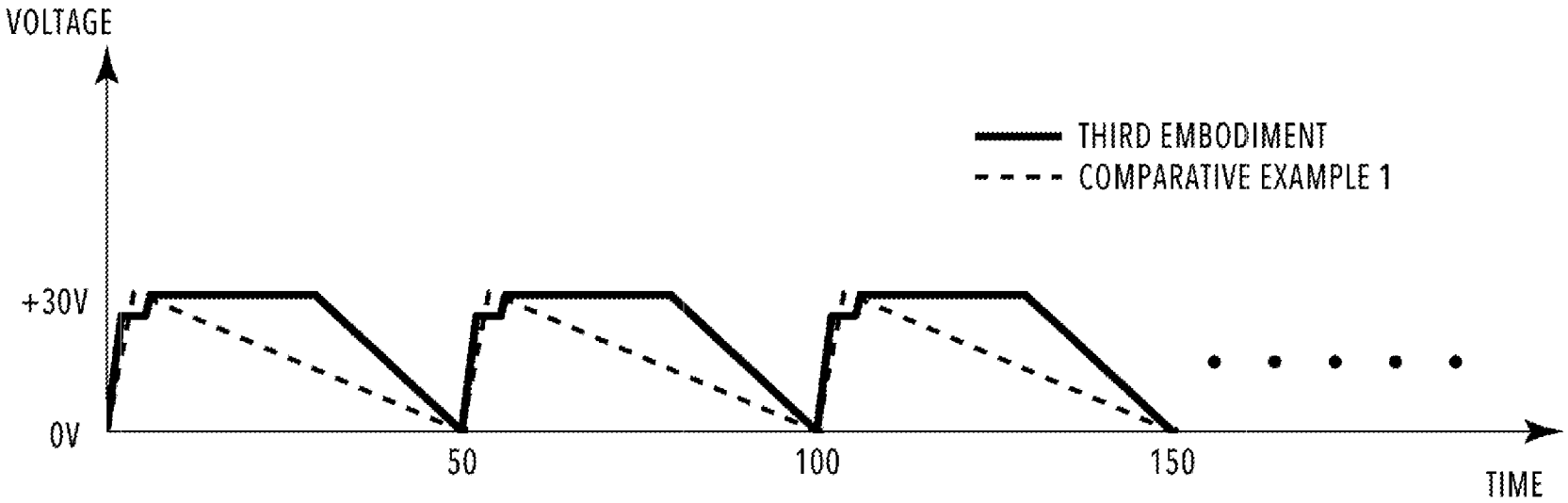
FIG. 14 is a graph showing a voltage waveform according to a third embodiment.

FIG. 14 is a graph showing a voltage waveform for driving the actuator 8 of this embodiment. In FIG. 14, the DC-BIAS at −30 V or below is applied, for example. However, illustration of this voltage is omitted therein. In FIG. 14, a solid line indicates this embodiment while a dashed line indicates a comparative example. The voltage waveform of this embodiment is similar to the shape in the second embodiment. Specifically, after the expansion driving in the one-stepped shape is conducted, the predetermined retention period is provided. Then, the voltage is decreased at a constant gradient. In FIG. 14, the direction of expansion of the capacity of the liquid feeding chamber 22 is defined as the positive direction of the voltage. Here, the maximum voltage is set to 30 V, the driving period is set to 50.0 μsec, and the driving frequency is set to 20 kHz. This driving frequency has a sufficiently higher value than the driving frequency of the energy generation element which is 15 kHz. By setting the driving frequency of the actuator 8 sufficiently higher than the driving frequency of the ejection element, it is possible to suppress a variation among respective ejecting operations of the ejection elements due to the driving of the actuator.

In the above-described embodiment as well, the liquid feeding efficiency can be improved by suppressing the increase and decrease in capacity associated with the Helmholtz vibration during the gradual contraction. As a consequence, it is possible to circulate the ink at a suitable velocity to the supply flow channels 5, the pressure chambers 3, the collection flow channels 6, the liquid feeding chamber 22, and the connection flow channel 7, and thus to stably supply the fresh ink to the vicinity of the ejection ports 2. As a consequence of observation by the inventors, it was confirmed that the liquid feeding amount per period was about 1.0 pL and the liquid feeding efficiency was about 7.0% in the case of performing the above-described driving by use of the ink at the viscosity of 2 cps.

Moreover, it was also confirmed that even in the case where the period in which no ejecting operation takes place lasts for several seconds to several tens of seconds, the normal ejecting operation was stably carried out thereafter without causing any ejection failures during the ejecting operation.

On the other hand, in the case where the voltage control is performed under the comparative example indicated with the dashed line in FIG. 14, the high liquid feeding efficiency is not available due to the overlap of the Helmholtz vibration during the gradual contraction. The inventors have confirmed that if the period in which no ejecting operation takes place lasted for several seconds to several tens of seconds, the ejecting operation thereafter would tend to fail ejection or to become unstable.

As described above, according to this embodiment, the inkjet printing head configured to eject the ink from the ejection ports is provided with the circulation flow channels for circulating a portion of the ink located in the vicinity of each ejection port and the actuator located in the circulation flow channels and configured to function as a circulation pump. Moreover, the voltage is applied to the actuator 104 in such a way as to repeat the period for increasing the voltage from the reference voltage to the target voltage in a short time and the period for decreasing the voltage from the target voltage to the reference voltage in a long time. In this case, during the period for increasing the voltage up to the target voltage, the voltage is first increased to the predetermined value lower than the target voltage and then the voltage is further increased to the target voltage by applying the voltage having the absolute value of the gradient lower than the absolute value of the gradient at the start of the driving. In the meantime, during the period for decreasing the voltage, the target voltage is retained for some time and then the voltage is changed into the reference voltage at the constant gradient.

According to this embodiment, even in the case of occurrence of the residual vibration having the Helmholtz frequency, the above-mentioned control can relax the change in capacity of the liquid feeding chamber associated with the residual vibration, thereby improving the liquid feeding efficiency of the liquid feeding apparatus as a whole. As a consequence, it is possible to supply the fresh ink constantly to each ejection port and to stabilize the state of ejection thereof.

Meanwhile, the flow channel block of this embodiment is not limited only to the mode shown in FIG. 12A. The number of the ejection elements (the pressure chambers 3) to circulate the ink with one liquid feeding mechanism 8 may be more or less than eight. In the meantime, the number of the supply flow channels 5 or the collection flow channels 6 to be provided in each flow channel block may be more or less than two.

Meanwhile, FIGS. 12A and 12B have described the example of the element board 4 in which the ejection elements are arranged in a line in the Y direction. However, two or more lines of the above-described ejection elements may be arranged in the X direction on the element board 4.

In the meantime, in this embodiment, the electrothermal conversion element is used as the energy generation element 1, and the ink is ejected by using the growth energy of the bubble generated by causing the film boiling therein. However, this disclosure is not limited to the above-described ejecting method. For example, the energy generation element may adopt any of elements of various modes such as the piezoelectric actuator, an electrostatic actuator, a mechanical/impact-drive actuator, a voice coil actuator, and a magnetostriction-drive actuator.

Moreover, the full-line printing head having the configuration in which the element boards 4 are arranged in the Y direction over the length corresponding to the width of the A4 size has been described as the example with reference to FIGS. 12A and 12B. However, the liquid ejection module of this embodiment is also applicable to a serial-type printing head. Nonetheless, the long printing head such as the full-line type printing head is more apt to develop the problems of this disclosure including the evaporation and deterioration in quality of the ink, and can therefore enjoy the advantageous effects of this disclosure more significantly.

Next, the control for achieving the change in capacity shown in FIG. 4B will be described with reference to fourth to sixth embodiments.

Fourth Embodiment

The liquid feeding apparatus described with reference to FIGS. 1A and 1B will also be used in a fourth embodiment.

Figure 15A:
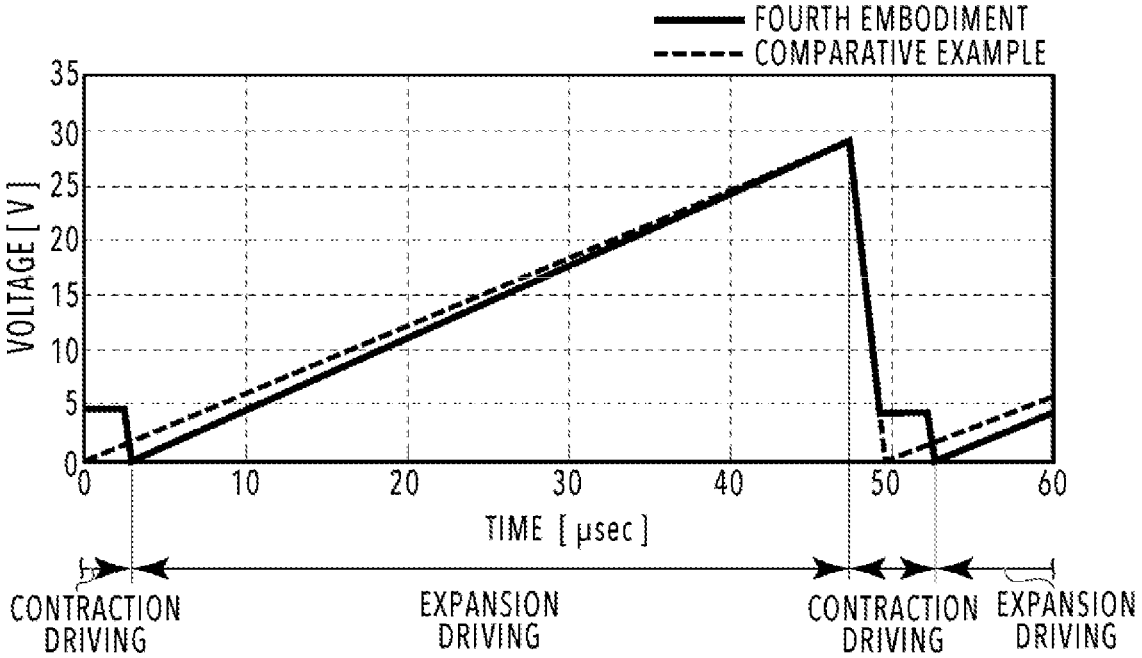
FIGS. 15A and 15B are graphs showing applied voltages and amounts of change in capacity of a liquid feeding chamber according to a fourth embodiment.
Figure 15B:
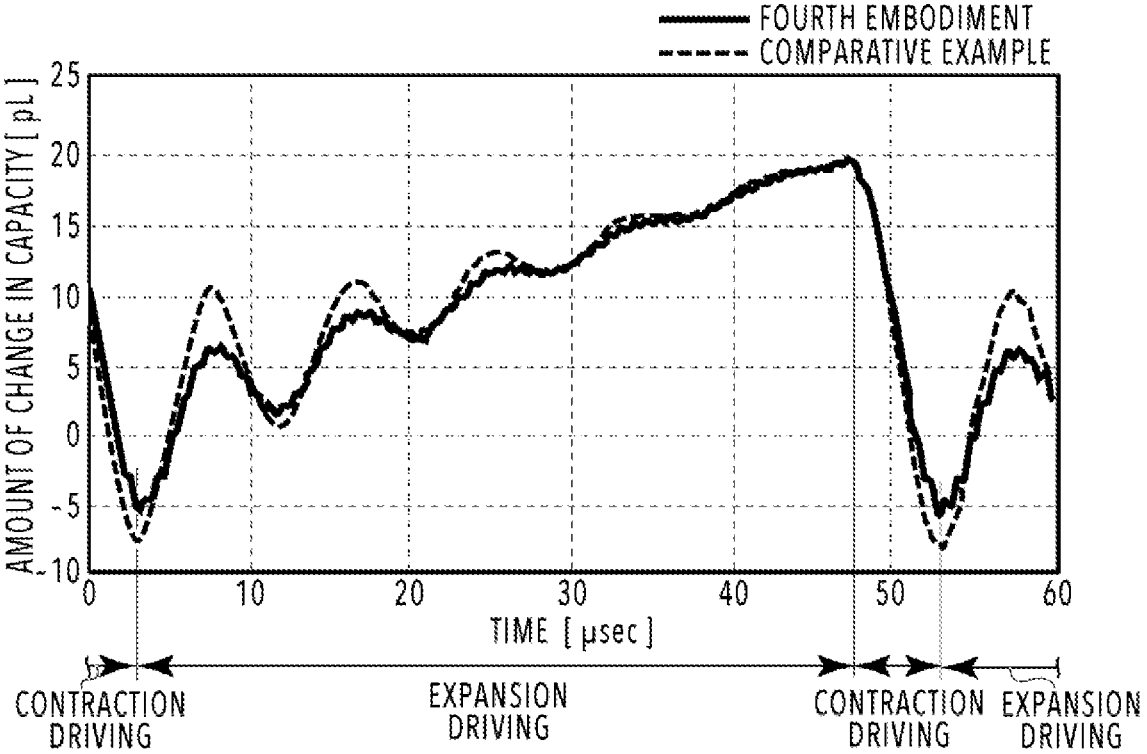

FIGS. 15A and 15B are graphs showing voltages to be applied to the actuator 104 and amounts of change in capacity of the liquid feeding chamber 101 to be increased and decreased depending on the voltages in this embodiment. In each of FIGS. 15A and 15B, a solid line indicates this embodiment while a dashed line indicates a comparative example.

In FIG. 15A, the DC-BIAS at −30 V or below is applied, for example. However, illustration of this voltage is omitted therein. FIG. 15A is a graph which illustrates a voltage waveform of this embodiment to be applied to the actuator 104 in comparison with a waveform in the comparative example. Here, the direction of expansion of the capacity of the liquid feeding chamber 101 is defined as the positive direction of the voltage. Meanwhile, the maximum voltage is set to 30 V, the driving period is set to 50.0 μsec, and the driving frequency is set to 20 kHz.

The voltage in the comparative example takes on the triangular voltage waveform that has heretofore been used in general. The voltage is increased from 0 V to 30 V at a constant gradient during a period from time t=0.0 μsec to time t=47.5 μsec. Then, the voltage is decreased from 30 V to 0 V at a constant gradient during a period from time t=47.5 μsec to time t=50.0 μsec. Thereafter, the aforementioned increase and decrease in voltage are repeated at a cycle of 50.0 μsec.

Meanwhile, in the fourth embodiment, the voltage is increased from 0 V to 30 V during a period from time t=2.9 μsec to time t≈47.5 μsec, and is decreased from 30 V to 5 V at a constant gradient during a period from time t≈47.5 μsec to time t≈49.6 μsec. Then, the voltage is maintained at 5 V during a period from time t≈49.6 μsec to time t≈52.5 μsec, and is decreased from 5 V to 0 V at a constant gradient during a period from time t≈52.5 μsec to time t≈52.9 μsec. Thereafter, the aforementioned increase and decrease in voltage are repeated at a cycle of 50.0 μsec.

In each of the comparative example and the fourth embodiment, the voltage is increased in a relatively long period and is decreased in a relatively short period. As a consequence, the capacity of the liquid feeding chamber 101 repeats gradual expansion and sudden contraction. Hence, repetition of the gradual expansion and the sudden contraction generates a constant flow heading in an opposite direction to that in the first embodiment.

Now, a mechanism for generating the constant flow in the liquid feeding chamber 101 will be briefly explained.

In the case where the liquid feeding chamber 101 is gradually expanded, no vortex is generated under a low flow velocity and the liquid slowly flows into the liquid feeding chamber 101. Next, in the case where the liquid feeding chamber 101 is suddenly contracted, a vortex is generated under a high flow velocity on the second connection flow channel 102 side in the second flow channel 106 where the flow channel resistance is low, and this vortex blocks the liquid that is likely to flow from the liquid feeding chamber 101 into the second flow channel 106. In the meantime, on the first connection flow channel 103 side where the flow channel resistance is high, the liquid can flow into or out of the liquid feeding chamber 101 irrespective of the rate of expansion or contraction of the liquid feeding chamber 101. In other words, the constant flow in the opposite direction (the −X direction) to the X direction in FIGS. 1A and 1B is generated by repeating the contraction that blocks the outflow to the second connection flow channel 102 and the expansion that does not block the inflow from the second connection flow channel 102.

FIG. 15B is a graph showing the amounts of change in capacity of the liquid feeding chamber 101 relative to the default state in the case of applying the voltages depicted in FIG. 15A. In each of the fourth embodiment and the comparative example, the capacity is increased during a period from time t=3.0 μsec to start the driving to time t=47.5 μsec by repeating the increase and decrease associated with the residual vibration while gradually reducing the amplitude. Thereafter, the capacity is contacted during a period from time t=47.5 μsec to time t=53.0 μsec and eventually returns to the initial value (the amount of change in capacity of 0). In FIGS. 15A and 15B, a period of expanding the capacity of the liquid feeding chamber 101 on average is indicated as the "expansion driving" while a period of contracting the capacity thereof on average is indicated as the "contraction driving".

In the comparative example and in the fourth embodiment as well, a period of the residual vibration of the amount of change in capacity is about 8.0 μsec, which represents that the primary period Th of the Helmholtz vibration being unique to the liquid feeding apparatus used in this embodiment is about 8.0 μsec and its Helmholtz frequency is therefore about 125 kHz. Now, if the above-mentioned residual vibration overlaps the change in capacity at the time of gradual expansion, the liquid feeding amount is impaired as a consequence.

Nonetheless, a comparison between the comparative example and the fourth embodiment reveals that the amplitude in the fourth embodiment is kept lower than that in the comparative example presumably due to the following reason. Specifically, if a period for retaining the voltage at a constant value (or for reducing the gradient of the drop in voltage) is set up within the "contraction driving" period as in the fourth embodiment, such a change in gradient of the voltage possibly acts on the amplitude of the residual vibration in a diminishing manner. According to the observation by the inventors of this disclosure, the liquid feeding amount per period was about 0.7 pL and the liquid feeding efficiency was about 4.5% in the comparative example, whereas the liquid feeding amount per period was about 1.1 pL and the liquid feeding efficiency was about 7.2% in the fourth embodiment. In other words, the fourth embodiment achieves the liquid feeding efficiency about 1.6 times as large as that of the comparative example.

FIGS. 16A to 16D are graphs showing examples of waveforms of the voltage to be applied to the actuator 104 in order to realize the change in capacity shown in FIG. 4B while conducting a comparison with a comparative example. In each of FIGS. 16A to 16D, the voltage applied to the actuator 104 is indicated with a solid line while the amount of change in capacity of the liquid feeding chamber 101 is indicated with a dashed line. In each of FIGS. 16A to 16D, the DC-BIAS at −30 V or below is applied, for example. However, illustration of this voltage is omitted therein.

Figure 16C:
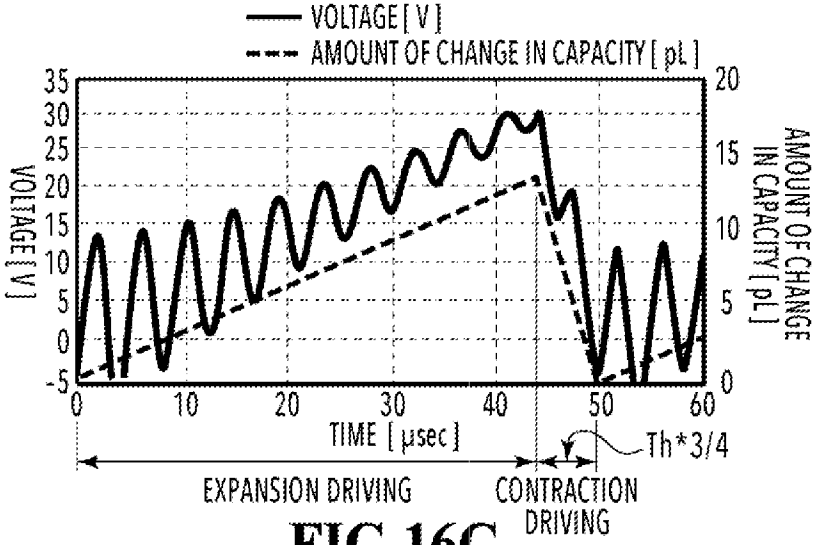
FIGS. 16A to 16D are graphs showing examples of waveforms of a voltage to be applied to an actuator.
Figure 16D:
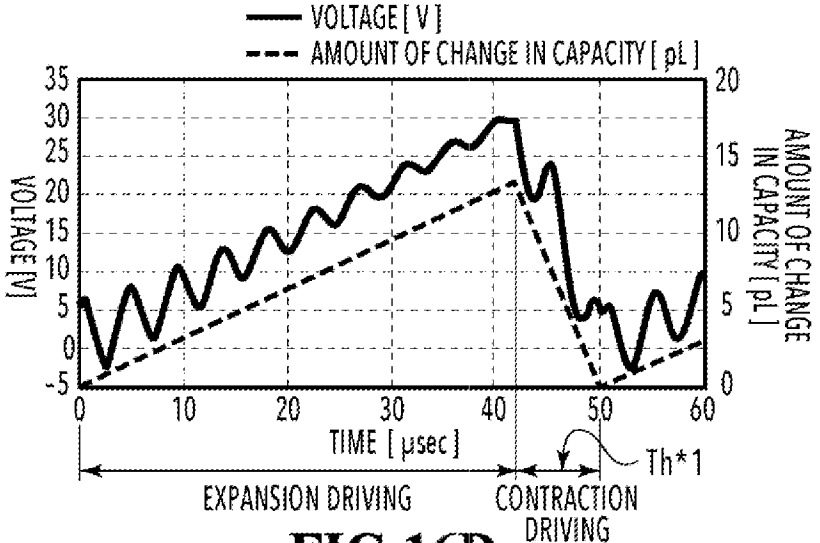
Figure 16A:
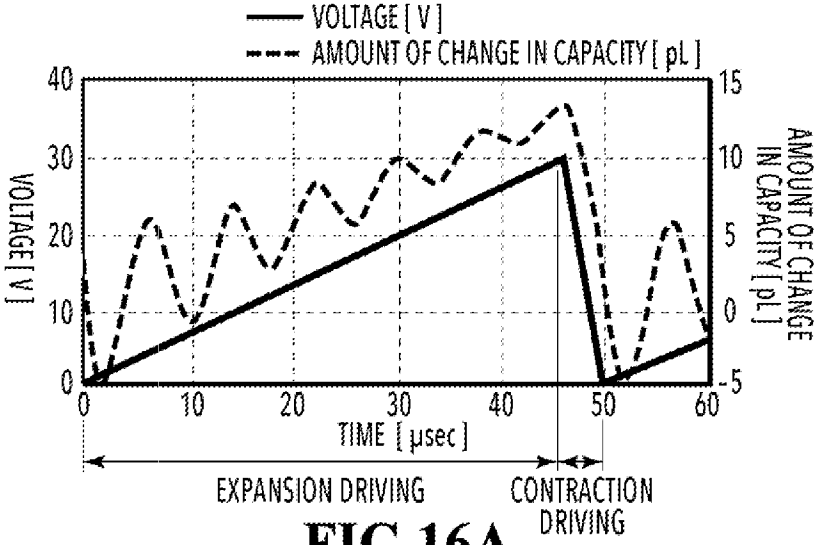

FIG. 16A shows a waveform (the solid line) of the voltage representing the comparative example and a change in capacity (the dashed line) of the liquid feeding chamber 101 associated therewith. A triangular voltage waveform that has heretofore been employed in general is used in the comparative example. Specifically, the voltage is increased from 0 V to 30 V at a constant gradient during a period from time t=0.0 μsec to time t=46.0 μsec. Then, the voltage is decreased from 30 V to 0 V at a constant gradient during a period from time t=46.0 μsec to time t=50.0 μsec.

As described previously, the Helmholtz frequency Fh is set to Fh=125 kHz and the Helmholtz period Th is set to Th=8.0 μsec in the system shown in FIGS. 1A and 1B. Accordingly, in the example shown in FIG. 16A, the period (from 0.0 μsec to 46.0 μsec) is allocated to the period for increasing the voltage while a period equivalent to Th×½(=4.0 μsec) is allocated to the period for decreasing the voltage. In this way, it is possible to efficiently contract the capacity of the liquid feeding chamber 101. Nonetheless, in the comparative example shown in FIG. 16A, the residual vibration of the Helmholtz period (about 8 μsec) overlaps the change in capacity at the time of gradual expansion, thereby leading to a loss in the liquid feeding amount as a consequence.

Figure 16B:
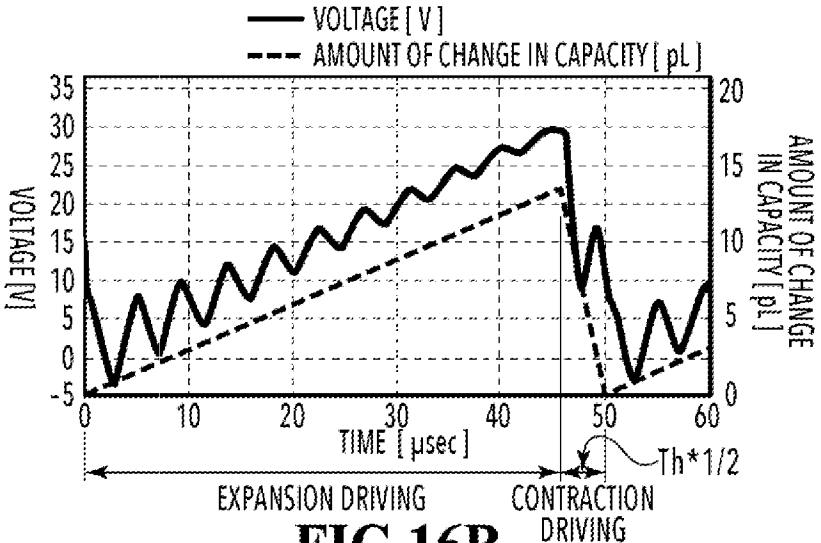

FIG. 16B shows an example of the voltage waveform to be applied to the actuator 104, which is obtained for realizing the change in capacity shown in FIG. 4B, and the change in capacity in the case of applying the voltage waveform. In this example, a period (from 0.0 μsec to 46.0 μsec) corresponds to the expansion driving while a period for Th×½ (from 46.0 μsec to 50.0 μsec) corresponds to the contraction driving. In this example, the voltage is not monotonously increased or decreased in the expansion driving or the contraction driving. Instead, the voltage is increased and decreased in each of the periods in such a way as to alternate a period projecting upward and a period projecting downward. Then, the high-precision voltage increases and decreases as described above almost completely cancel out the residual vibration having the Helmholtz period in the course of the change in capacity of the liquid feeding chamber 101.

FIG. 16C shows another example of the voltage waveform to be applied to the actuator 104, which is obtained for realizing the change in capacity shown in FIG. 4B, and the change in capacity in the case of applying the voltage waveform. In this example, a period (from 0.0 μsec to 44.0 μsec) corresponds to the expansion driving while a period for Th×¾ (from 44.0 μsec to 50.0 μsec) corresponds to the contraction driving. In this example as well, the voltage is increased and decreased in each of the periods in such a way as to alternate a period projecting upward and a period projecting downward. Thus, the residual vibration having the Helmholtz period is almost completely cancelled out.

FIG. 16D shows still another example of the voltage waveform to be applied to the actuator 104, which is obtained for realizing the change in capacity shown in FIG. 4B, and the change in capacity in the case of applying the voltage waveform. In this example, a period (from 0.0 μsec to 42.0 μsec) corresponds to the expansion driving while a period for Th×1 (from 42.0 μsec to 50.0 μsec) corresponds to the contraction driving. In this example as well, the voltage is increased and decreased in each of the periods in such a way as to alternate a period projecting upward and a period projecting downward. Thus, the residual vibration having the Helmholtz period is almost completely cancelled out.

In short, if any of the waveform voltages indicated with the solid lines in FIGS. 16B to 16D can be applied to the actuator 104, the change in capacity of the liquid feeding chamber 101 turns out as indicated with the corresponding dashed line so that high liquid feeding efficiency can be achieved. In actual driving control, however, it is difficult to perform complex waveform control at high precision as indicated with the solid lines in FIGS. 16B to 16D, because the more complex the waveform is the more types of the voltage values need to be prepared, thus leading to complexity of a circuit and increases in costs.

With that in mind, the inventors have sought any factors possibly effective for suppressing the residual vibration out of characteristics common to the waveforms shown in FIG. 16B to 16D in order to suppress the residual vibration by using a simpler waveform, and have focused on inflection points of the voltage waveforms. Moreover, the inventors have found out that there were inflection points in the waveforms shown in FIGS. 16B to 16D each at every Th×½ interval during the contraction driving period as with the cases explained with reference to FIGS. 5B to 5D, and have acquired the knowledge that the presence of the inflection points is effective for suppressing the residual vibration.

Specifically, as with the first embodiment, the effect to suppress the restorative vibration can be expected even by using a simpler voltage waveform. To be more precise, in a falling period to decrease the voltage from the maximum voltage to the initial voltage, it is only necessary to decrease the voltage first from the maximum voltage to a predetermined value and then to bring the voltage further down to the initial voltage by applying a voltage having an absolute value of a gradient smaller than an absolute value of a gradient at the start of driving.

FIGS. 17A to 17D are graphs showing examples of relatively simple waveforms that satisfy the aforementioned conditions. Each of these waveforms satisfies the aforementioned conditions so that the waveform can achieve the effect of suppressing the restorative vibration. Note that the gradient of each of the waveforms shown in FIGS. 17A to 17D may be slightly increased or slightly decreased once after the voltage almost reached the target value. Meanwhile, in each of FIGS. 17A to 17D, the falling period to decrease the voltage from the maximum voltage to the initial voltage is set to Th/2. However, the falling period may be set in a range from about Th×(½-⅛) to Th×(½+¼). For example, the falling period is close to Th/2 in the case of a stepped waveform shown in FIG. 17A. Meanwhile, the falling period is larger than Th/2 in the case of a ramp-shaped waveform shown in FIG. 17B. An upper limit of this range is set to Th×(½+¼) in consideration of actual use.

Figure 17A:
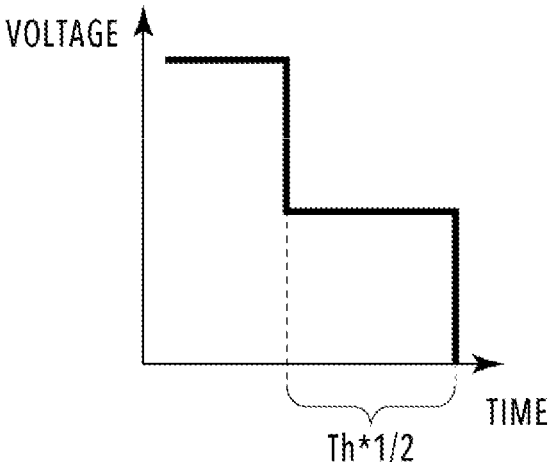
FIGS. 17A to 17D are graphs showing examples of simple waveforms.
Figure 17C:
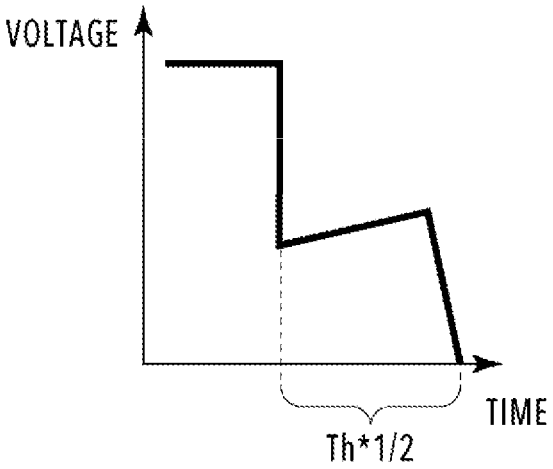
Figure 17B:
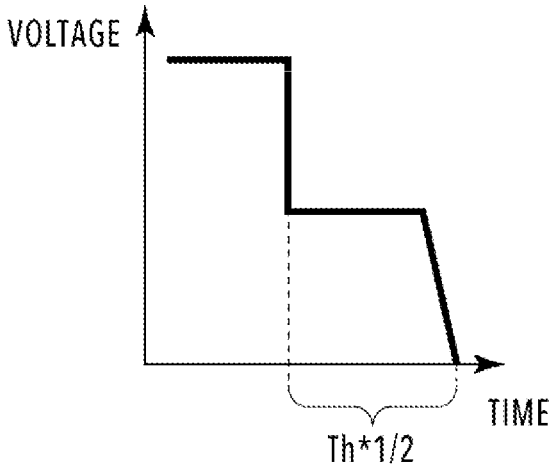
Figure 17D:
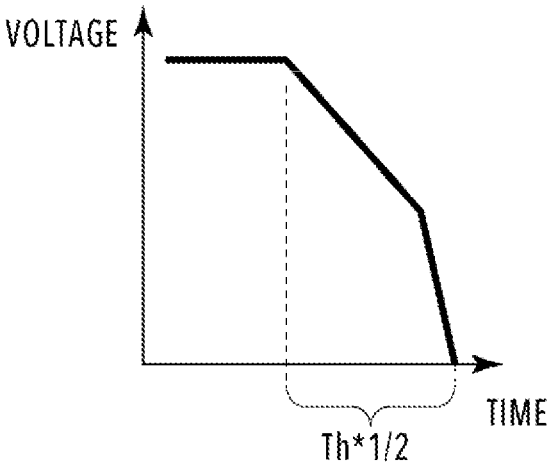
Figure 18A:
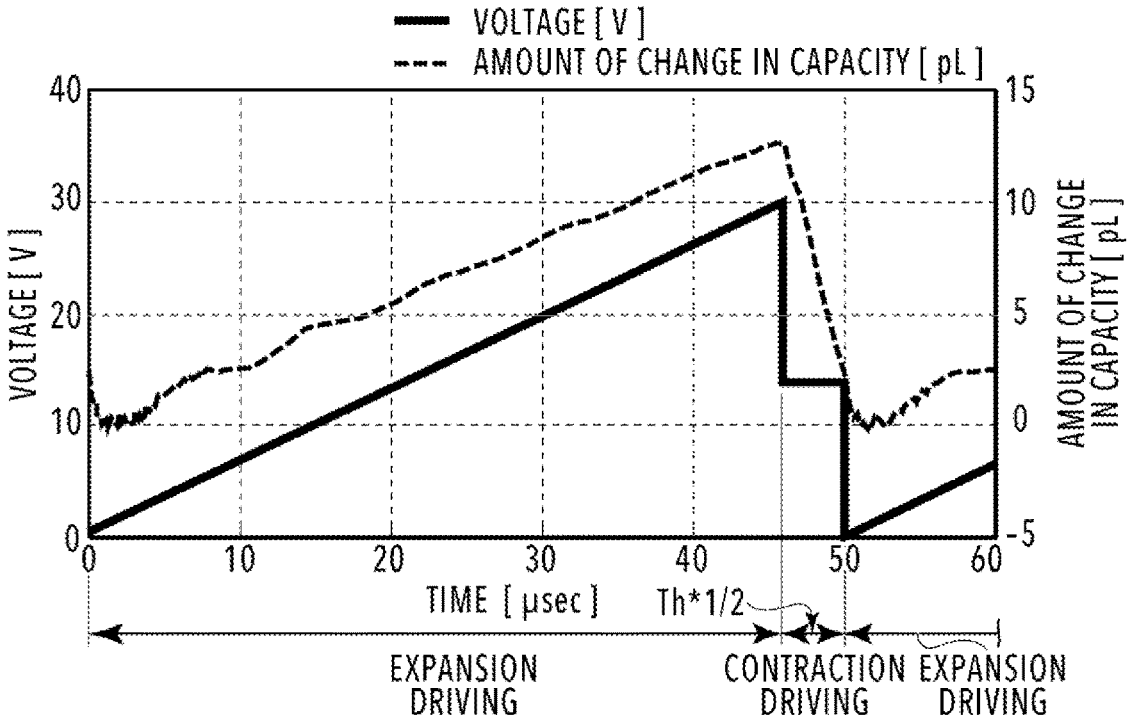
FIGS. 18A and 18B are graphs showing results of simulation in a case of using stepped waveforms.
Figure 18B:
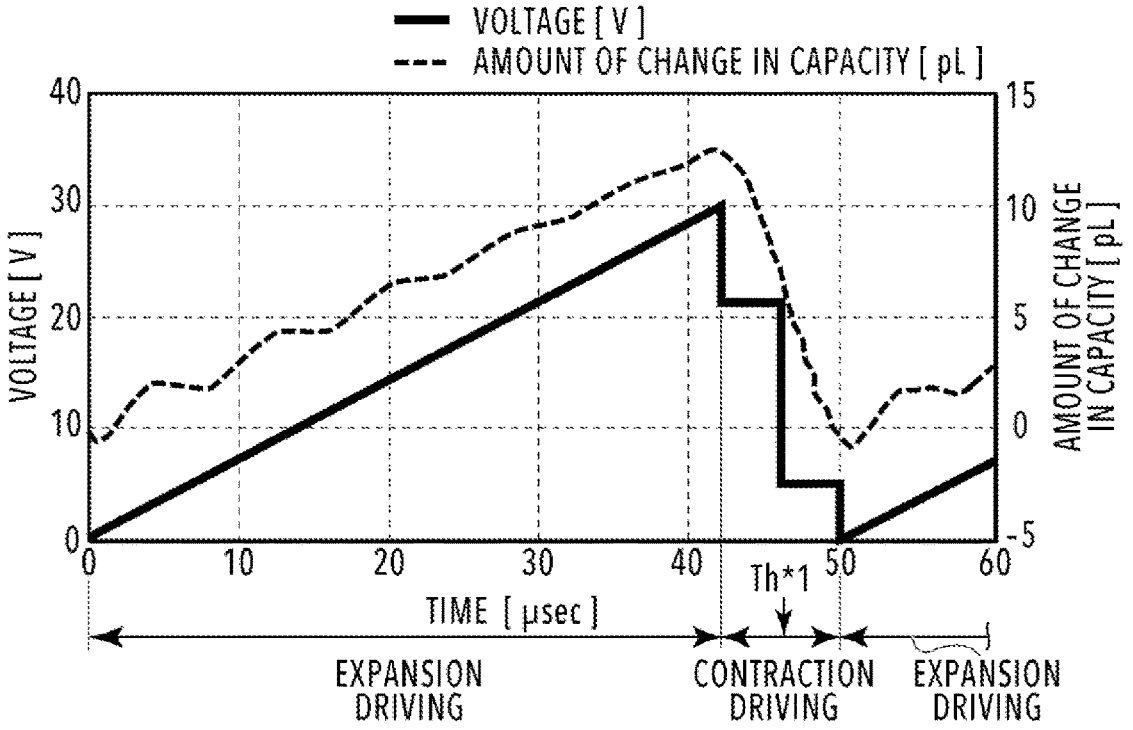

FIGS. 18A and 18B are graphs showing results of simulation in the case of adopting the stepped waveform as shown in FIG. 17A. In each of FIGS. 18A and 18B, the DC-BIAS at −30 V or below is applied, for example. However, illustration of this voltage is omitted therein. FIG. 18A corresponds to a simplified form of the waveform in FIG. 16B in which a single stepped form is put into the contraction driving period (Th×½). On the other hand, FIG. 18B corresponds to a simplified form of the waveform in FIG. 16D in which a double stepped form is put into the contraction driving period (Th×1). In each case, the residual vibration slightly overlaps the amount of change in capacity at the time of expansion driving. Nonetheless, the amplitude is significantly suppressed in contrast to the comparative example shown in FIG. 16A.

In FIG. 18A, a voltage (hereinafter referred to as the retained voltage) corresponding to a flat portion in the stepped form is set to a half (15 V) of the maximum voltage. However, the retained voltage is not limited to this value. For example, the effect of suppressing the amplitude of the residual vibration will be improved further by setting the retained voltage higher than 15 V. However, setting the retained voltage too high may cause a failure to obtain a sufficient flow velocity as the prepared voltage (30 V) is not fully used for the contraction driving, and may therefore result in deterioration in liquid feeding efficiency. For this reason, the retained voltage needs to be adjusted such that both of the purpose to suppress the residual vibration and the purpose to exert the fluid valve function are achieved with an appropriate balance. As a result of studies conducted by the inventors, it was confirmed that the retained voltage would preferably be set about 0.05 times to 0.6 times as high as the maximum voltage.

Meanwhile, in FIG. 18B, a first retained voltage is set 0.75 times as high as the maximum voltage while a second retained voltage is set 0.25 times as high as the maximum voltage. However, the retained voltages are not limited to these values. These two retained voltages may be adjusted to appropriate values, respectively, on the same grounds as those explained with reference to FIG. 18A. As a result of studies conducted by the inventors, it was confirmed that the first retained voltage would preferably be set about 0.525 times to 0.8 times as high as the maximum voltage and the second retained voltage would preferably be set about 0.025 times to 0.3 times as high as the maximum voltage.

Here, with reference to FIG. 15A again, it is apparent that the waveform of the fourth embodiment indicated with the solid line in FIG. 15A satisfies the conditions described above. Specifically, the value of the applied voltage is first decreased from 30 V to 5 V in the contraction driving period (from 47.5 μsec to 49.6 μsec) for decreasing the voltage value from the maximum voltage of 30 V. Next, the voltage at 5 V is applied at the absolute value (0) of the gradient smaller than the absolute value (25 V/2.1 μsec) of the gradient at the start of the driving. Then, the voltage is further decreased down to 0 V. In this case, the retained voltage (5 V) is about 0.2 times as high as the maximum voltage (30 V). The value of this ratio falls within the range from 0.05 times to 0.6 times.

As described above, according to this embodiment, the voltage is applied to the actuator 104 in such a way as to repeat the period for increasing the voltage from the reference voltage to the maximum voltage in a long time and the period for decreasing the voltage from the maximum voltage to the reference voltage in a short time. Then, during the period for decreasing the voltage down to the reference voltage, the voltage is first decreased to the predetermined value higher than the reference voltage and then the voltage is further decreased to the reference voltage by applying the voltage having the absolute value of the gradient lower than the absolute value of the gradient at the start of the driving. Even in the case of occurrence of the residual vibration having the Helmholtz frequency, the above-mentioned control can relax the change in capacity of the liquid feeding chamber associated with the residual vibration, thereby improving the liquid feeding efficiency of the liquid feeding apparatus as a whole.

Fifth Embodiment

Figure 19A:
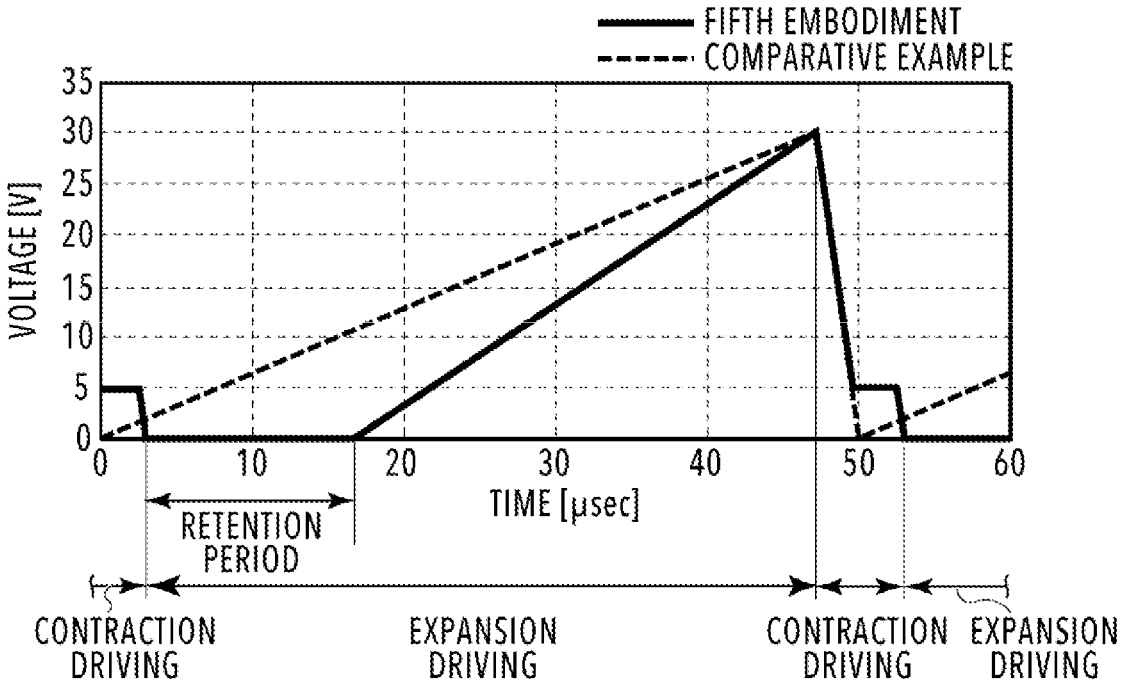
FIGS. 19A and 19B are graphs showing applied voltages and amounts of change in capacity of a liquid feeding chamber according to a fifth embodiment.
Figure 19B:
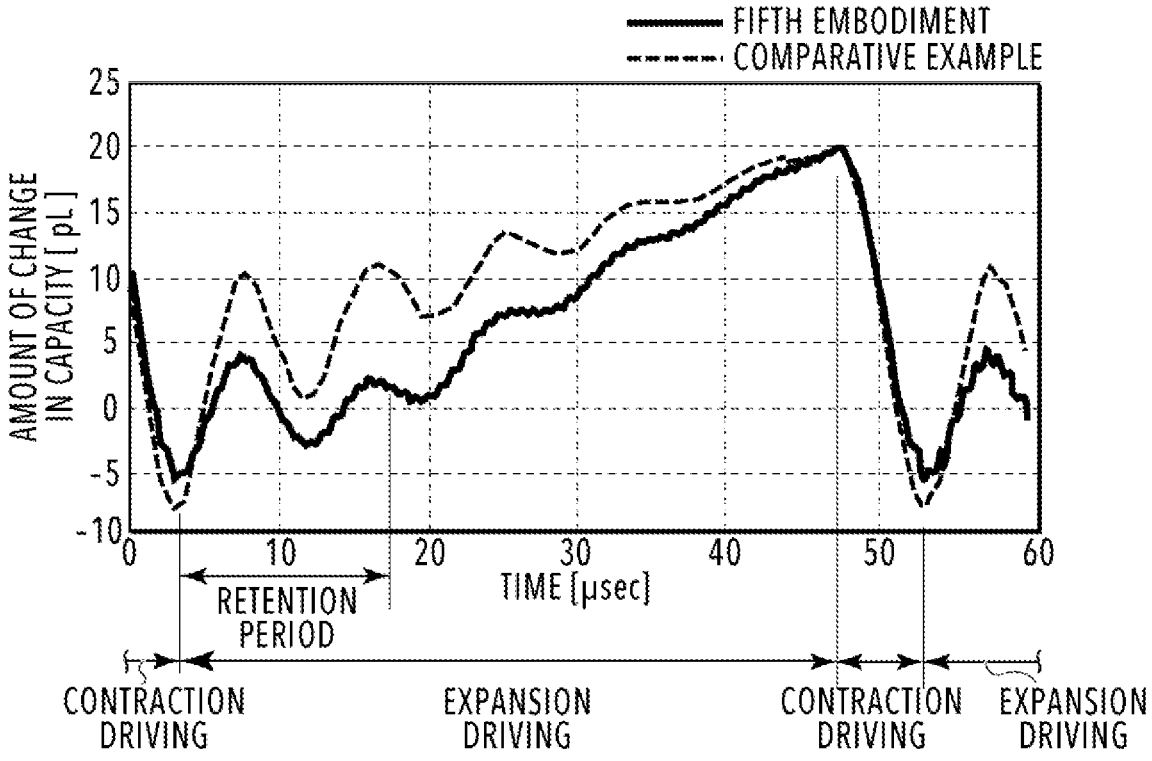

The liquid feeding apparatus described with reference to FIGS. 1A and 1B will also be used in a fifth embodiment. FIGS. 19A and 19B are graphs showing voltages to be applied to the actuator 104 and amounts of change in capacity of the liquid feeding chamber 101 to be increased and decreased depending on the voltages in the fifth embodiment, which are depicted as with the FIGS. 15A and 15B described in conjunction with the fourth embodiment. In FIG. 19A, the DC-BIAS at −30 V or below is applied, for example. However, illustration of this voltage is omitted therein. A comparative example is the same as that in the fourth embodiment.

The fifth embodiment is different from the fourth embodiment in that the "retention period" is defined in the "expansion driving" period. Specifically, in the fifth embodiment, the voltage is decreased to the reference voltage in the same manner as the fourth embodiment, then the voltage is retained for a period from time t=2.9 μsec to 18.4 μsec, and then the voltage is increased at a constant gradient and brought up to the maximum voltage at time t=47.5 μsec as shown in FIG. 19A.

FIG. 19B is a graph showing the amount of change in capacity of the liquid feeding chamber 101 in the case of applying the voltage as shown in FIG. 19A. In the fifth embodiment as well, the capacity is increased during a period from the start of driving at time t=2.9 μsec to time t=47.5 μsec while repeating the increase and decrease associated with the residual vibration, and then the voltage is decreased back to the original value (the amount of change in capacity of 0). In FIG. 19B, the period in which the capacity of the liquid feeding chamber 101 is basically expanded is indicated as the "expansion driving", the period in which the capacity is basically contracted is indicated as the "contraction driving", and the period within the "contraction driving" period in which the reference voltage of 0 V is retained is indicated as the "retention period".

It is apparent that the fifth embodiment also reduces the amplitude as compared to the comparative example indicated with the dashed line.

The concept of the length of the retention period of this embodiment is the same as the second embodiment although the liquid feeding direction is opposite to that in the second embodiment. As a result of studies conducted by the inventors, it was confirmed that the liquid efficiency corresponding to the retention period had its maximum value and the appropriate range of the retention period would preferably be set about 1.0 times to 2.5 times as long as the Helmholtz period unique to the system. If the retention period is set more than 2.5 times of the unique period, the period for expansion comes close to the period for contraction, and the function to move the liquid to the predetermined direction by using the difference in flow velocity cannot be fully obtained. On the other hand, the retention period also has an impact on the structural designs and the voltage conditions of the liquid feeding apparatus. From this point of view, it is preferable to set the retention period in the range from about $(1/4-1/8)\times Th$ to $(10+1/8)\times Th$.

As a result of studies conducted by the inventors, it was confirmed that the flow velocity at the time of feeding the liquid in the fifth embodiment was about 1.8 times as fast as the flow velocity of the comparative example. Moreover, it was confirmed that the liquid feeding amount per period was about 0.7 pL and the liquid feeding efficiency was about 4.5% in the comparative example whereas the liquid feeding amount per period was about 1.3 pL and the liquid feeding efficiency was about 8.5% in the fifth embodiment. This result means that the fifth embodiment can reduce the loss in the liquid feeding amount more than the comparative example and can improve the liquid feeding efficiency as the liquid feeding apparatus by about 1.9 times. Moreover, even in the case of using the same liquid feeding apparatus, the fifth embodiment further improves the liquid feeding efficiency as compared to the fourth embodiment.

As described above, according to this embodiment, the voltage is applied to the actuator 104 in such a way as to repeat the period for increasing the voltage from the reference voltage to the maximum voltage in a long time and the period for decreasing the voltage from the maximum voltage to the reference voltage in a short time. Then, during the period for decreasing the voltage down to the reference voltage, the voltage is first decreased to the predetermined value higher than the reference voltage and then the voltage is further decreased to the reference voltage by applying the voltage having the absolute value of the gradient lower than the absolute value of the gradient at the start of the driving. In the meantime, during the period for increasing the voltage, the reference voltage is retained for some time and then the voltage is changed into the maximum voltage at the constant gradient. Even in the case of occurrence of the residual vibration having the Helmholtz frequency, the above-mentioned control can relax the change in capacity of the liquid feeding chamber associated with the residual vibration, thereby improving the liquid feeding efficiency of the liquid feeding apparatus as a whole.

Sixth Embodiment

This embodiment is configured to circulate the ink in an opposite direction to the flowing direction of the ink realized in the third embodiment. Hence, the structure is the same as the third embodiment while only the driving method is different therefrom. Realization of the direction of circulation in the sixth embodiment has an advantage that the bubbles mixed in from the nozzle side, for example, can be collected on the supply port 15 side without flowing into the liquid feeding chamber 22.

Figure 20A:
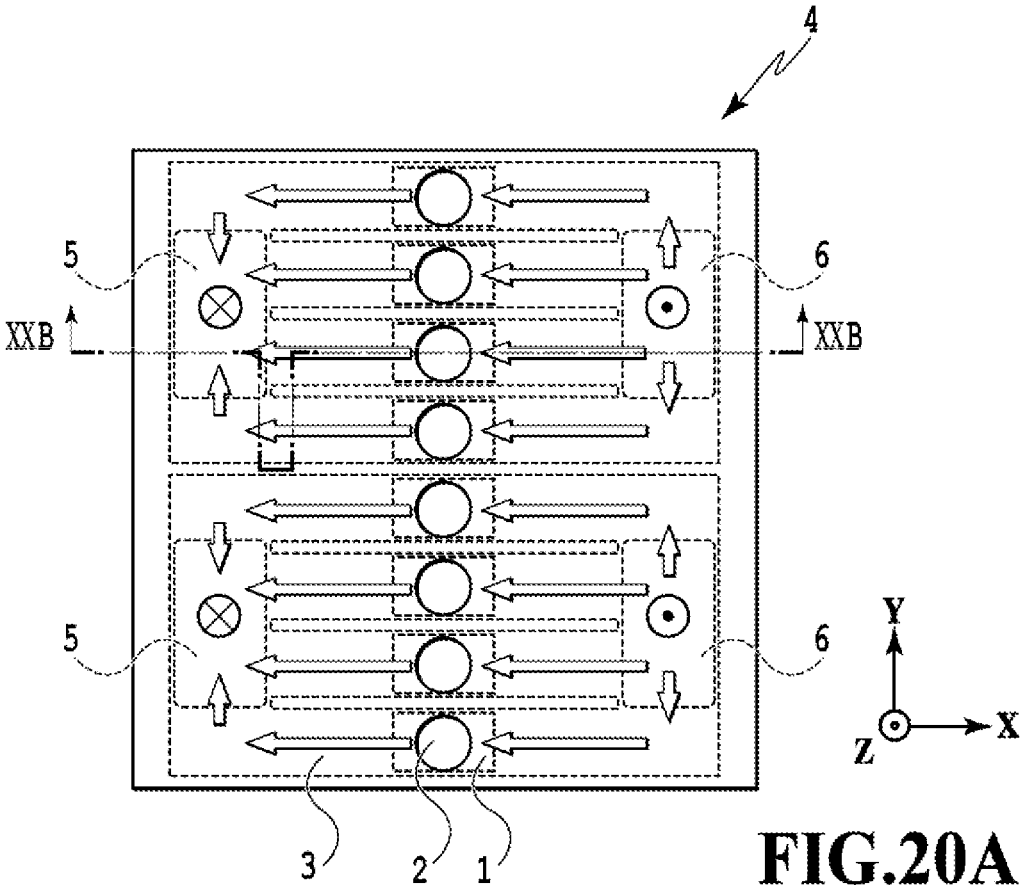
FIGS. 20A and 20B are diagrams showing a flow channel configuration of a flow channel block.
Figure 20B:
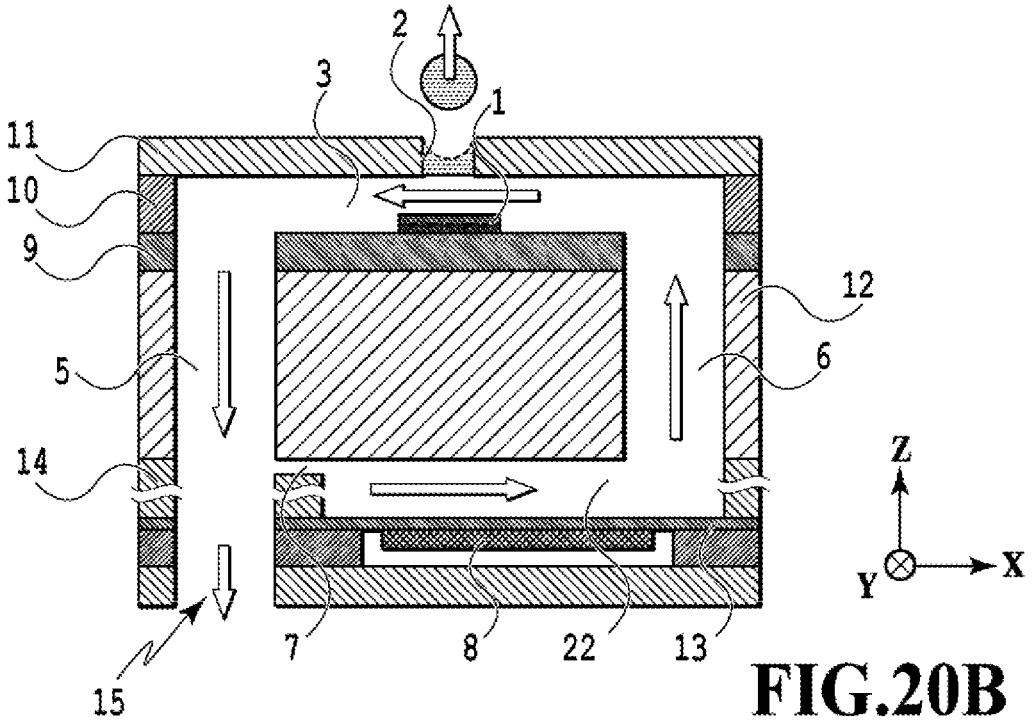

FIGS. 20A and 20B are diagrams showing a flow channel configuration of one flow channel block in the element board 4 of this embodiment. The same reference numerals as those in FIGS. 12A and 12B represent the same mechanisms as those in the third embodiment. The direction of the gravitational force is the +Z direction. If the bubbles are mixed in from the ejection port 2, this configuration can carry the bubbles on the circulating flow and collect the bubbles on the supply port 15 side by means of buoyancy.

Figure 21:
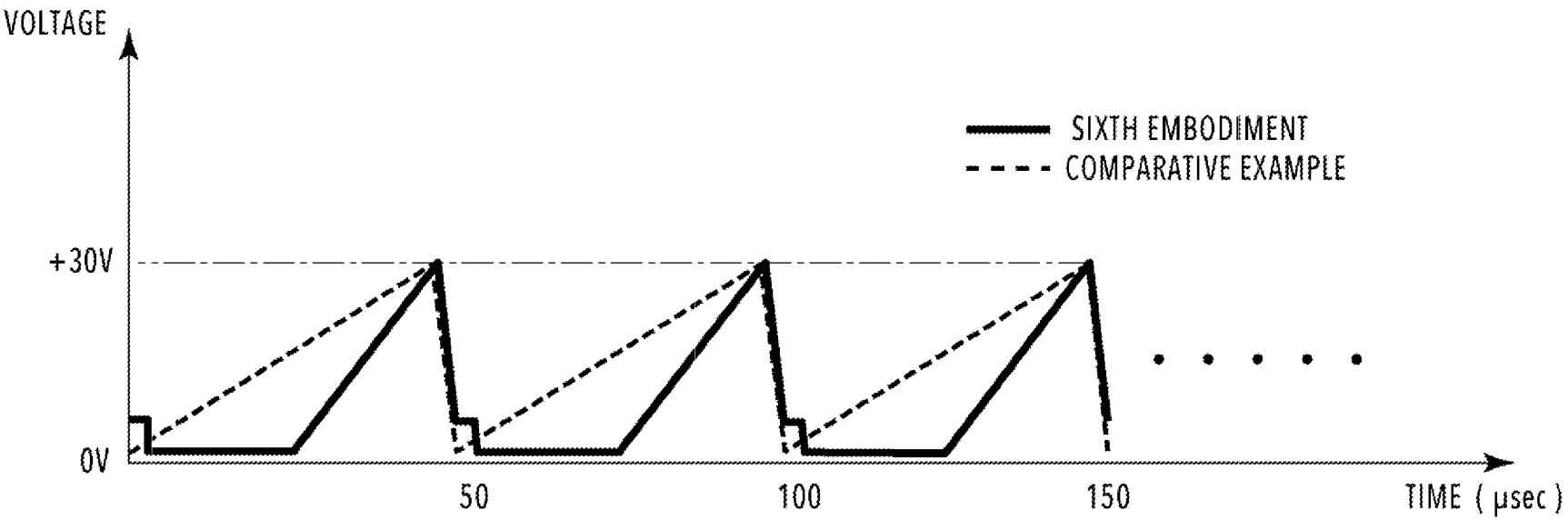
FIG. 21 is a graph showing a voltage waveform according to a sixth embodiment.

FIG. 21 is a graph showing a voltage waveform for driving the actuator 8 of this embodiment. In FIG. 21, the DC-BIAS at −30 V or below is applied, for example. However, illustration of this voltage is omitted therein. In FIG. 21, a solid line indicates this embodiment while a dashed line indicates a comparative example. The voltage waveform of this embodiment is similar to the waveform in the fifth embodiment. Specifically, after the contraction driving in the one-stepped shape is conducted, the predetermined retention period is provided. Then, the voltage is increased at a constant gradient. In FIG. 21, a direction of expansion of the capacity of the liquid feeding chamber 22 is defined as the positive direction of the voltage. Here, the maximum voltage is set to 30 V, the driving period is set to 50.0 μsec, and the driving frequency is set to 20 kHz. This driving frequency has a sufficiently higher value than the driving frequency of the energy generation element which is 15 kHz. By setting the driving frequency of the actuator 8 sufficiently higher than the driving frequency of the ejection element, it is possible to suppress a variation among respective ejecting operations of the ejection elements due to the driving of the actuator.

In the above-described embodiment as well, the liquid feeding efficiency can be improved by suppressing the increase and decrease in capacity associated with the Helmholtz vibration during the gradual expansion. As a consequence, it is possible to circulate the ink at a suitable velocity to the supply flow channels 5, the pressure chambers 3, the collection flow channels 6, the liquid feeding chamber 22, and the connection flow channel 7, and thus to stably supply the fresh ink to the vicinity of the ejection ports 2. As a consequence of observation conducted by the inventors, it was confirmed that the liquid feeding amount per period was about 1.0 pL and the liquid feeding efficiency was about 7.0% in the case of performing the above-described driving by use of the ink at the viscosity of 2 cps.

Moreover, it was also confirmed that even in the case where the period in which no ejecting operation takes place lasts for several seconds to several tens of seconds, the normal ejecting operation was stably carried out thereafter without causing any ejection failures during the ejecting operation.

On the other hand, in the case where the voltage control is performed under the comparative example indicated with the dashed line in FIG. 21, the high liquid feeding efficiency is not available due to the overlap of the Helmholtz vibration during the gradual expansion. The inventors have confirmed that if the period in which no ejecting operation takes place lasted for several seconds to several tens of seconds, the ejecting operation thereafter would tend to fail ejection or to become unstable.

As described above, according to this embodiment, the inkjet printing head configured to eject the ink from the ejection ports is provided with the circulation flow channels for circulating a portion of the ink located in the vicinity of each ejection port and the actuator located in the circulation flow channels and configured to function as a circulation pump. Moreover, the voltage is applied to the actuator 104 in such a way as to repeat the period for increasing the voltage from the reference voltage to the target voltage in a long time and the period for decreasing the voltage from the target voltage to the reference voltage in a short time.

In this case, during the period for increasing the voltage, the reference voltage is retained for some time and then the voltage is increased to the target voltage at a constant gradient. During the period for decreasing the voltage, the voltage is first decreased to the predetermined value higher than the reference voltage and is then decreased further down to the reference voltage by applying the voltage having the absolute value of the gradient smaller than the absolute value of the gradient at the start of driving.

According to this embodiment, even in the case of occurrence of the residual vibration having the Helmholtz frequency, the above-mentioned control can relax the change in capacity of the liquid feeding chamber associated with the residual vibration, thereby improving the liquid feeding efficiency of the liquid feeding apparatus as a whole. As a consequence, it is possible to supply the fresh ink constantly to each ejection port and to stabilize the state of ejection thereof.

This embodiment can also select other modes similar to those described in conjunction with the third embodiment.

Other Embodiments

In the above-described embodiments, the simplified waveforms as shown in FIGS. 2A, 8A, 14, 15A, 19A, and 21 have been demonstrated and the effects thereof have been explained on the premise that it was difficult to perform the control of the complex voltages at high precision. Nevertheless, these embodiments do not intend to exclude the waveforms indicated with the solid lines in FIGS. 5B to 5D and in FIGS. 16B to 16D. Needless to say, the liquid feeding efficiency will be further improved if it is possible to conduct the voltage control at high precision as indicated with the solid lines in FIGS. 5B to 5D and in FIGS. 16B to 16D. In this case, assuming that Th is the Helmholtz period unique to the liquid feeding apparatus, the period of the vibration to overlap the voltage during the contraction driving or the expansion driving is preferably set in a range from $(\frac{1}{4}-\frac{1}{8})\times$ Th to $(\frac{1}{2}+\frac{1}{8})\times$Th.

In each case, the waveform of the voltage to be applied to the actuator 104 only needs to be controlled during the expansion driving or the contraction driving such that the inflection point emerges in each predetermined interval based on the Helmholtz vibration period Th unique to the system. In this way, it is possible to obtain the effect of this disclosure to suppress the residual vibration.

Meanwhile, the embodiments have been described above on the premise that the initial voltage was set to 0 V, the target (maximum) voltage was set to 30 V, and the capacity of the liquid feeding chamber was supposed be increased more as the voltage became higher. However, it is needless to say that this disclosure is not limited only to these embodiments. For example, the voltage at the default state does not have to be equal to 0 V, or the actuator may be arranged in such a way as to reduce the capacity of the liquid feeding chamber more as the voltage becomes higher.

In any case, the voltage to be applied to the actuator may be controlled:

i) in such a way as to repeat a first period in which the voltage is changed from a first voltage to a second voltage and a second period which is a longer period than the first period and in which the voltage is changed from the second voltage to the first voltage; and ii) in such a way that the inflection point emerges in each predetermined interval during the first period based on the period Th of the Helmholtz vibration unique to the system.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-247865 filed Dec. 28, 2018, and No. 2019-177314 filed Sep. 27, 2019, which are hereby incorporated by reference herein in their entirety.

What is claimed is:

1. A driving method of a liquid feeding apparatus including a liquid chamber configured to store a liquid, and a driving element provided in the liquid chamber and configured to circulate a liquid stored in the liquid chamber to an external unit by expanding and contracting a capacity of the liquid chamber along with application of a voltage, the method comprising:

controlling the voltage applied to the driving element in such a way as to repeat a first period in which the voltage is changed from a first voltage to a second voltage and a second period which is a longer period than the first period and in which the voltage is changed from the second voltage to the first voltage; and controlling the voltage applied to the driving element such that an inflection point is provided in each predetermined interval during the first period based on a Helmholtz vibration period unique to the liquid feeding apparatus.

2. The driving method according to claim 1, wherein the first period includes:

a period in which the voltage applied to the driving element is changed from the first voltage at a predetermined gradient; and a period in which the voltage applied the driving element is changed at an absolute value of a gradient less than an absolute value of the predetermined gradient.

3. The driving method according to claim 1, wherein the predetermined interval falls within a range from (½-⅛)×Th to (½+¼)×Th where Th is the Helmholtz vibration period unique to the liquid feeding apparatus.

4. The driving method according to claim 1, wherein the second period includes:

a retention period in which the voltage applied to the driving element is retained at the second voltage; and a period in which the voltage applied to the driving element is changed from the second voltage to the first voltage.

5. The driving method according to claim 4, wherein the retention period falls within a range from (¼-⅛)×Th to (10+⅛)×Th where Th is the Helmholtz vibration period unique to the liquid feeding apparatus.

6. The driving method according to claim 1, wherein the second voltage is higher than the first voltage, the first period corresponds to a period of expansion of the capacity of the liquid chamber, and the second period corresponds to a period of contraction of the capacity of the liquid chamber.

7. The driving method according to claim 6, wherein the second voltage is a maximum voltage to be applied to the driving element, in a case in which the first period includes one inflection point, a voltage at the inflection point has a value from 0.40 times to 0.95 times as high as the second voltage, and in a case in which the first period includes two inflection points, a voltage at a first inflection point has a value from 0.20 times to 0.475 times as high as the second voltage and a voltage at a second inflection point has a value from 0.70 times to 0.975 times as high as the second voltage.

8. The driving method according to claim 1, wherein the first voltage is higher than the second voltage, the first period corresponds to a period of contraction of the capacity of the liquid chamber, and the second period corresponds to a period of expansion of the capacity of the liquid chamber.

9. The driving method according to claim 8, wherein the first voltage is a maximum voltage to be applied to the driving element, in a case in which the first period includes one inflection point, a voltage at the inflection point has a value from 0.05 times to 0.6 times as high as the first voltage, and in a case in which the first period includes two inflection points, a voltage at a first inflection point has a value from 0.525 times to 0.8 times as high as the first voltage and a voltage at a second inflection point has a value from 0.025 times to 0.3 times as high as the first voltage.

10. The driving method according to claim 1, wherein a time of the second period is in a range from equal to or above 3 times to equal to or below 100 times a time of the first period.

11. The driving method according to claim 1, wherein the voltage applied to the driving element in the second period is controlled in such a way as to change the capacity of the liquid chamber while repeating increases and decreases within a period in a range from (¼-⅛)×Th to (½+⅛)×Th where Th is the Helmholtz vibration period unique to the liquid feeding apparatus.

12. The driving method according to claim 1, wherein the Helmholtz vibration period unique to the liquid feeding apparatus is equal to or below 25 μsec.

13. The driving method according to claim 1, wherein the driving element is an actuator including:

a thin-film piezoelectric body;

electrodes used to apply a voltage to the thin-film piezoelectric body; and a diaphragm configured to change the capacity of the liquid chamber by being displaced along with application of the voltage to the thin-film piezoelectric body.

14. The driving method according to claim 1, wherein the liquid chamber includes:

an ejection port to eject the stored liquid to outside; and an energy generation element configured to generate energy to be used to eject the liquid from the ejection port.

* * * * *